US007085516B2

(12) United States Patent
Kawai et al.

(10) Patent No.: US 7,085,516 B2
(45) Date of Patent: Aug. 1, 2006

(54) PROCESS CARTRIDGE AND ELECTROPHOTOGRAPHIC IMAGE FORMING APPARATUS

(75) Inventors: Tachio Kawai, Odawara (JP); Kojiro Yasui, Shizuoka-ken (JP); Kinya Harada, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 72 days.

(21) Appl. No.: 10/351,849

(22) Filed: Jan. 28, 2003

(65) Prior Publication Data

US 2003/0156848 A1 Aug. 21, 2003

(30) Foreign Application Priority Data

Jan. 31, 2002 (JP) ..... 2002-022674

(51) Int. Cl.
*G03G 15/00* (2006.01)

(52) U.S. Cl. ..... 399/111

(58) Field of Classification Search ..... 399/111, 399/90, 110, 107, 113, 27, 109
See application file for complete search history.

(56) References Cited

U.S. PATENT DOCUMENTS

| | | | | |
|---|---|---|---|---|
| 5,500,714 | A | 3/1996 | Yashiro et al. | 355/200 |
| 5,543,898 | A | 8/1996 | Shishido et al. | 355/210 |
| 5,617,579 | A | 4/1997 | Yashiro et al. | 399/114 |
| 5,619,309 | A | 4/1997 | Yashiro et al. | 399/111 |
| 5,652,647 | A | 7/1997 | Yashiro et al. | 399/111 |
| 5,689,774 | A | 11/1997 | Shishido et al. | 399/111 |
| 5,903,803 | A | 5/1999 | Kawai et al. | 399/116 |
| 5,943,529 | A * | 8/1999 | Miyabe et al. | 399/11 |
| 6,041,203 | A * | 3/2000 | Suzuki et al. | 399/111 |
| 6,055,406 | A | 4/2000 | Kawai et al. | 399/360 |
| 6,061,535 | A | 5/2000 | Yokomori et al. | 399/61 |
| 6,064,842 | A | 5/2000 | Takeuchi et al. | 399/111 |
| 6,115,567 | A | 9/2000 | Kawai et al. | 399/106 |
| 6,128,452 | A * | 10/2000 | Miyabe et al. | 399/90 |
| 6,128,454 | A | 10/2000 | Kawai et al. | 399/116 |
| 6,163,665 | A | 12/2000 | Watanabe et al. | 399/111 |
| 6,173,145 | B1 * | 1/2001 | Chadani et al. | 399/265 |
| 6,175,706 | B1 | 1/2001 | Watanabe et al. | 399/167 |
| 6,185,390 | B1 * | 2/2001 | Higeta et al. | 399/90 |
| 6,226,478 | B1 | 5/2001 | Watanabe et al. | 399/117 |
| 6,240,266 | B1 | 5/2001 | Watanabe et al. | 399/117 |

(Continued)

FOREIGN PATENT DOCUMENTS

JP 2-163761 6/1990

(Continued)

*Primary Examiner*—Quana Grainger
(74) *Attorney, Agent, or Firm*—Fitzpatrick, Cella, Harper & Scinto

(57) ABSTRACT

A process cartridge detachably mountable to a main assembly of an electrophotographic image forming apparatus, includes a first frame; a second frame coupled with the first frame for rotation about a shaft relative to each other; a first electrical contact, provided in the first frame, for receiving, from the main assembly, a bias voltage to be supplied to the charging member; a second electrical contact, provided in the second frame, for receiving, from the main assembly, a bias voltage to be supplied to a developing member, a developer feeding member and a regulating member; and a third electrical contact, provided in the first frame coaxially with the drum, for electrically grounding the drum to the main assembly. The first and second contents are disposed at one end of the first frame and the second frame, respectively, and the third contact is disposed at the other end of the first frame, and wherein the contacts are disposed such that, the first contact takes a higher position than the second.

20 Claims, 18 Drawing Sheets

U.S. PATENT DOCUMENTS

| | | | | |
|---|---|---|---|---|
| 6,272,299 | B1 | 8/2001 | Numagami et al. | 399/111 |
| 6,308,028 | B1 | 10/2001 | Yashiro et al. | 399/111 |
| 6,336,018 | B1 | 1/2002 | Kawai et al. | 399/117 |
| 6,381,430 | B1 | 4/2002 | Yokomori et al. | 399/119 |
| 6,400,914 | B1 | 6/2002 | Noda et al. | 399/90 |
| 6,408,142 | B1 | 6/2002 | Takeuchi et al. | 399/13 |
| 6,463,232 | B1 | 10/2002 | Kawai et al. | 399/111 |
| 6,480,687 | B1 | 11/2002 | Kawai et al. | 399/111 |
| 6,496,667 | B1 | 12/2002 | Shiratori et al. | 399/103 |
| 6,501,926 | B1 | 12/2002 | Watanabe et al. | 399/117 |
| 6,501,927 | B1 | 12/2002 | Watanabe et al. | 399/117 |
| 2002/0018666 | A1 | 2/2002 | Noda et al. | 399/90 |
| 2002/0018668 | A1 | 2/2002 | Kanno et al. | 399/106 |
| 2002/0031368 | A1 | 3/2002 | Kanno et al. | 399/103 |
| 2002/0110386 | A1 | 8/2002 | Kanno et al. | 399/111 |
| 2004/0086300 | A1 | 5/2004 | Kawai et al. | 399/167 |

FOREIGN PATENT DOCUMENTS

| | | |
|---|---|---|
| JP | 6-83123 | 3/1994 |
| JP | 10-20743 | 1/1998 |
| JP | 10-186822 | 7/1998 |
| JP | 10-240103 | 9/1998 |
| JP | 11-73004 | 3/1999 |
| JP | 2000-75613 | 3/2000 |
| JP | 2000-75641 | 3/2000 |

* cited by examiner

PROCESS CARTRIDGE AND ELECTROPHOTOGRAPHIC IMAGE FORMING APPARATUS

FIELD OF THE INVENTION AND RELATED ART

The present invention relates to a process cartridge and an electrophotographic image forming apparatus employing a process cartridge.

Herein, an electrophotographic image forming apparatus is an apparatus which forms an image on a recording medium, with the use of an electrophotographic image forming method. It includes, for example, an electrophotographic copying machine, an electrophotographic printer (a laser beam printer, an LED printer, etc.), a facsimile machine, a word processor, etc.

A process cartridge is a cartridge in which at least an electrophotographic photoconductive member, and a developing means functioning as a processing means and a charging means, are integrally disposed to make them removably mountable in the main assembly of an image forming apparatus. A processing means includes at least a cleaning means, in addition to a developing means and a charging means.

Conventionally, an electrophotographic image forming apparatus using an electrophotographic image forming process employs a process-cartridge system, according to which an electrophotographic photoconductive member, and a single or plurality of processing means which act on the electrophotographic photoconductive member, are integrally disposed in a cartridge removably mountable in the main assembly of an image forming apparatus. A process-cartridge system enables a user to maintain an image forming apparatus by himself or herself, that is, without relying on service personnel, drastically improving operational efficiency. Thus, a process-cartridge system has been widely used in the field of an electrophotographic image forming apparatus.

On the other hand, it has been desired to make it easier to removably mount a process cartridge in the main assembly of an image forming apparatus employing a process-cartridge system.

A process cartridge has two or more electrical contacts different in type. Thus, it has been desired to improve a process-cartridge system to assure that when mounting a process cartridge into the main assembly of an image forming apparatus, a more precise and reliable electrical connection is established between the process cartridge and the main assembly.

Further, it has been desired to make compact the main assembly of an image forming apparatus, that is, to reduce the space the main assembly occupies.

One example of the technologies which make it possible to realize the above-described improvements is disclosed in Japanese Laid-open Patent Application 02-163761 (published on Jun. 25, 1990), according to which a process cartridge has an electrical contact connected to a charging device, an electrical contact connected to a charging grid, a drum grounding plate (contact) connected to a photoconductive drum, an electrical bias contact connected to a developing device, and an antenna contact connected to an antenna, and these contacts are on the side walls of the process cartridge.

The technologies, such as the one described above, are very effective to reliably establish electrical connection between a process cartridge and the main assembly of an image forming apparatus, and the present invention is a result of further development of these technologies.

The primary object of the present invention is to provide a combination of a process cartridge and an electrophotographic image forming apparatus which ensures that when the process cartridge is mounted into the main assembly of the image forming apparatus, a more precise electrical connection is established between the process cartridge and the main assembly.

Another object of the present invention is to provide a combination of a process cartridge and an electrophotographic image forming apparatus, which improves image quality by ensuring that a more precise electrical connection is established between the process cartridge and the main assembly of the image forming apparatus.

Another object of the present invention is to provide a combination of a process cartridge and an electrophotographic image forming apparatus, which makes it easier to mount the process cartridge into the main assembly of the image forming apparatus, and which also ensures that more precise electrical connection is established between the process cartridge and the main assembly.

Another object of the present invention is to better dispose a process cartridge driving means and an electrical wiring substrate in the main assembly of an electrophotographic image forming apparatus, in terms of spatial efficiency, so that it becomes possible to provide an electrophotographic image forming apparatus, the main assembly of which is smaller than that of an image forming apparatus in accordance with the prior art, and also to provide a process cartridge compatible with such an electrophotographic image forming apparatus.

Another object of the present invention is to better dispose the various electrical contacts of a process cartridge, in terms of spatial efficiency, so that it becomes possible to provide a smaller process cartridge, and a smaller electrophotographic image forming apparatus compatible with such a process cartridge.

According to an aspect of the present invention, there is provided a process cartridge detachably mountable to a main assembly of an electrophotographic image forming apparatus, comprising a first frame; a second frame coupled with the first frame for rotation about a shaft relative to each other; an electrophotographic photosensitive drum provided in the first frame; a photosensitive member charging member, provided in the first frame, for electrically charging the electrophotographic photosensitive drum; a developing member, provided in the second frame, for developing an electrostatic latent image formed on the photosensitive drum with a developer; a developer feeding member, provided in the second frame, for supplying a developer onto a peripheral surface of the developing member; a regulating member, provided in the second frame, for regulating the amount of the developer deposited on the peripheral surface of the developing member; a first electrical contact, provided in the first frame, for receiving, from the main assembly of the image forming apparatus, a bias voltage to be supplied to the photosensitive member charging member when the process cartridge is mounted to the main assembly of the image forming apparatus; a third electrical contact, provided in the second frame, for receiving, from the main assembly of the image forming apparatus, a bias voltage to be supplied to said developing member, the developer feeding member and the regulating member when the process cartridge is mounted to the main assembly of the image forming apparatus; a fourth electrical contact, provided in the first frame coaxially with the photosensitive drum, for electrically grounding the photosensitive drum to the main assembly of the image forming apparatus when the process cartridge is mounted to the main assembly of the image forming apparatus, wherein the first frame has one and the other longitudinal ends, and the second frame has one and the other longitudinal ends adjacent the one and the other longitudinal ends of the first frame, respectively, and wherein the first electrical contact and the third electrical contact are disposed at the one longitudinal ends of the first frame and the second frame, respectively, and the fourth electrical contact is disposed at the other longitudinal end of the first frame, and wherein the electrical contacts are disposed such that when the process cartridge is mounted to the main assembly of the image forming apparatus, the first electrical contact takes an upper position, and the third electrical contact takes a lower position.

According to another aspect of the present invention, there is provided an electrophotographic image forming apparatus for forming an image on a recording material to which a process cartridge is detachably mountable, the apparatus comprising; (a) a first main assembly electrical contact; (c) a third main assembly electrical contact; (d) a fourth main assembly electrical contact; (e) a cartridge-mounting portion for detachably mounting the process cartridge, the process cartridge including a first frame; a second frame coupled with the first frame for rotation about a shaft relative to each other; an electrophotographic photosensitive drum provided in the first frame; a photosensitive member charging member, provided in the first frame, for electrically charging the electrophotographic photosensitive drum; a developing member, provided in the second frame, for developing an electrostatic latent image formed on the photosensitive drum with a developer; a developer feeding member, provided in the second frame, for supplying a developer onto a peripheral surface of the developing member; a regulating member, provided in the second frame, for regulating the amount of the developer deposited on the peripheral surface of the developing member; a first electrical contact, provided in the first frame, for contacting the first main assembly electrical contact to receive, from the main assembly of the image forming apparatus, a bias voltage to be supplied to the photosensitive member charging member when process cartridge is mounted to the main assembly of the image forming apparatus; a third electrical contact, provided in the second frame, for contacting the second main assembly electrical contact to receive, from the main assembly of the image forming apparatus, a bias voltage to be supplied to the developing member, the developer feeding member and the regulating member when the process cartridge is mounted to the main assembly of the image forming apparatus; a fourth electrical contact, provided in the first frame coaxially with the photosensitive drum, for contacting the fourth main assembly electrical contact to electrically ground the photosensitive drum to the main assembly of the image forming apparatus when process cartridge is mounted to the main assembly of the image forming apparatus, wherein the first frame has one and the other longitudinal ends, and the second frame has one and the other longitudinal ends adjacent the one and the other longitudinal ends of the first frame, respectively, and wherein the first electrical contact and the third electrical contact are disposed at the one longitudinal ends of the first frame and the second frame, respectively, and the fourth electrical contact is disposed at the other longitudinal end of the first frame, and wherein the electrical contacts are disposed such that when the process cartridge is mounted to the main assembly of the image forming apparatus, the first electrical contact takes an upper position, and the third electrical contact takes a lower position.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, preferred embodiments of the present invention will be described with reference to the appended drawings.

Figure 1:
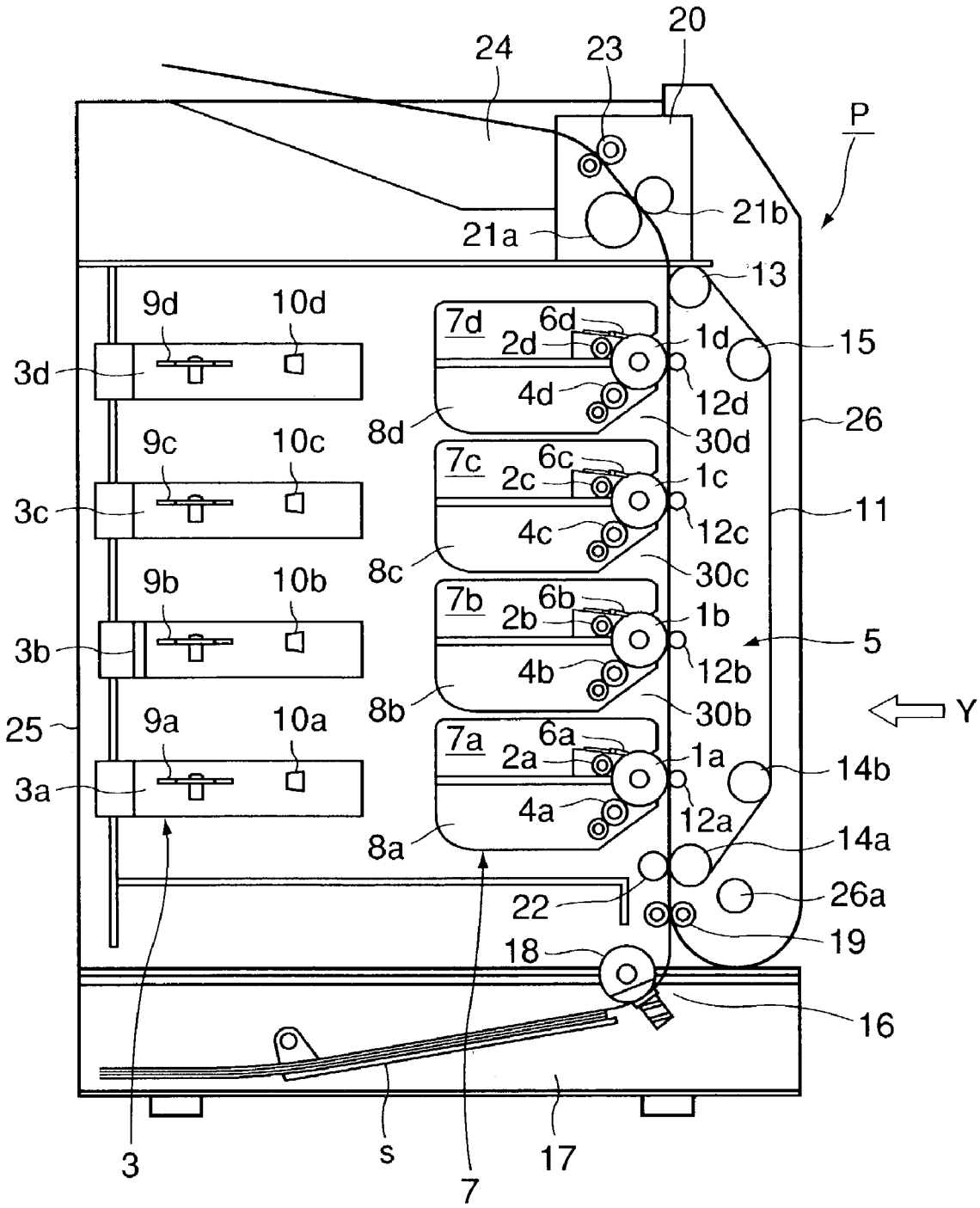
FIG. 1 is a vertical sectional view of an embodiment of an image forming apparatus in accordance with the present invention, in which a process cartridge in accordance with the present invention is removably mountable, for showing the general structure thereof.

First, referring to FIG. 1, the general structure and image forming process of an embodiment of an electrophotographic image forming apparatus in accordance with the present invention will be described. FIG. 1 is a vertical sectional view of a full-color laser beam printer, that is, an embodiment of an image forming apparatus in accordance with the present invention, for showing the general structure thereof.

The image forming apparatus P shown in FIG. 1 comprises a plurality (four in FIG. 1) of cartridge-mounting portions into which a plurality of process cartridges 7 (which hereinafter may be referred to simply as cartridge) comprising a photoconductive drum are mounted, one for one. These cartridge-mounting portions are vertically stacked in parallel. In each cartridge 7 (7*a*, 7*b*, 7*c*, 7*d*), the photoconductive drum 1 (1*a*, 1*b*, 1*c*, and 1*d*) is rotationally driven by a driving means (unshown) in the counterclockwise direction. Around the peripheral surface of the photoconductive drum (1*a*, 1*b*, 1*c*, 1*d*), a charging apparatus (2*a*, 2*b*, 2*c*, 2*d*) for uniformly charging the peripheral surface of the photoconductive drum (1*a*, 1*b*, 1*c*, 1*d*), a scanner unit (3*a*, 3*b*, 3*c*, 3*d*) for forming an electrostatic latent image on the peripheral surface of the photoconductive drum by projecting a beam of laser light modulated with image-formation information, and a developing apparatus (4*a*, 4*b*, 4*c*, 4*d*) for adhering developer to the electrostatic latent image in order to develop the electrostatic latent image, are disposed in the mentioned order, in terms of the rotational direction of the photoconductive drum. Further, the full-color laser beam printer comprises an electrostatic transferring apparatus 5 for transferring a developer image on the photoconductive drum onto a recording medium S. The electrostatic transferring apparatus 5 comprises an electrostatic transfer belt 11 and a transfer roller (12*a*, 12*b*, 12*c*, 12*d*). The full-color laser printer also comprises a cleaning apparatus (6*a*, 6*b*, 6*c*, 6*d*) for removing the developer remaining on the peripheral surface of the photoconductive drum after the image transfer therefrom.

Figure 4:
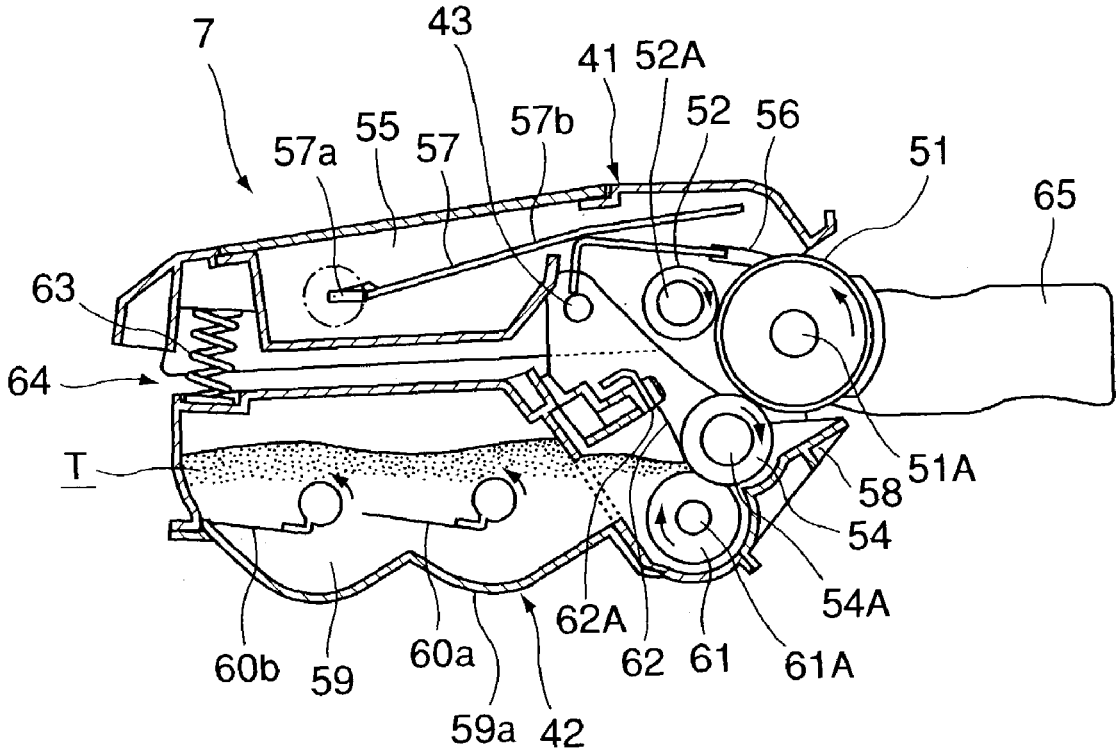
FIG. 4 is a schematic sectional view of the embodiment of a process cartridge in accordance with the present invention, for showing the general structure thereof.

The photoconductive drum (1*a*, 1*b*, 1*c*, 1*d*), the charging apparatus (2*a*, 2*b*, 2*c*, 2*d*), the developing apparatus (4*a*, 4*b*, 4*c*, 4*d*), the cleaning apparatus (6*a*, 6*b*, 6*c*, 6*d*), a developer storage portion (8*a*, 8*b*, 8*c*, and 8*d*), etc., are integrally disposed in the cartridge 7 (7*a*, 7*b*, 7*c*, 7*d*). The detailed structure of the cartridge 7 is shown in FIG. 4. Each cartridge 7 (7*a*, 7*b*, 7*c*, 7*d*) is removably mounted in the corresponding cartridge mounting portion 30 (30*a*, 30*b*, 30*c*, 30*d*) of the main assembly 25 (which hereinafter will be referred to simply as the apparatus main assembly) of the full-color laser beam printer. The scanner unit 3 (3*a*, 3*b*, 3*c*, 3*d*) is attached to the apparatus main assembly so that it opposes the cartridge 7 (7*a*, 7*b*, 7*c*, 7*d*) when the cartridge 7 (7*a*, 7*b*, 7*c*, 7*d*) is in the cartridge-mounting portion 30 (30*a*, 30*b*, 30*c*, 30*d*).

Next, the various components will be described regarding their structure, in the logical order. The cartridges 7*a*, 7*b*, 7*c*, and 7*d* are virtually identical in structure.

The photoconductive drum (1*a*, 1*b*, 1*c*, 1*d*) comprises an aluminum cylinder, for example, with a diameter of 30 mm, and a layer of organic photoconductor coated on the peripheral surface of the aluminum cylinder. It is rotationally supported by a pair of bearings 66 and 67 (FIG. 5), by the lengthwise end portions of its drum shaft. To one of the lengthwise ends of the photoconductive drum, a driving force is transmitted from a motor (unshown) provided on the apparatus-main-assembly side, as will be described later in more detail. As a driving force is transmitted, the photoconductive drum is rotationally driven in the counterclockwise direction of FIG. 1.

The charging apparatus (2*a*, 2*b*, 2*c*, 2*d*) is of a type which employs a contact-charging method. The charging apparatus has an electrically conductive roller, which is placed in contact with the peripheral surface of the photoconductive drum. The peripheral surface of the photoconductive drum is uniformly charged by applying charge bias, that is, a certain amount of voltage, is applied, with the charge roller being kept in contact with the peripheral surface of the photoconductive drum.

The scanner unit 3 (3*a*, 3*b*, 3*c*, 3*d*) is horizontally disposed virtually in parallel to the photoconductive drums (1*a*, 1*b*, 1*c*, 1*d*). The scanner unit 3 comprises a laser diode (unshown) which emits image-formation light modulated with image-formation signals; a scanner motor (unshown); a polygon mirror (9*a*, 9*b*, 9*c*, 9*d*) rotated by the scanner motor; and a focusing lens (10*a*, 10*b*, 10*c*, 10*d*). The image-formation light emitted from the laser diode is projected toward the polygon mirror (9*a*, 9*b*, 9*c*, 9*d*), being thereby deflected. The deflected image-formation light is focused on the charged peripheral surface of the photoconductive drum (1*a*, 1*b*, 1*c*, 1*d*), selectively exposing the numerous points of the peripheral surface of the photoconductive drum. As a result, an electrostatic latent image, different in its corresponding primary color component from those formed in the other process cartridges, is formed on the photoconductive drum.

The developing apparatuses 4*a*, 4*b*, 4*c*, and 4*d* have developer storage portions (8*a*, 8*b*, 8*c*, 8*d*) holding yellow, magenta, cyan, and black developers, respectively. Each developing apparatus develops an electrostatic latent image formed on the corresponding photoconductive drum (1*a*, 1*b*, 1*c*, 1*d*), into an image formed of the developer, by adhering the developer contained therein to the electrostatic latent image. In the developer storage portion 8*a* of the cartridge 7*a*, developer with the yellow color is stored. Similarly, in the developer storage portions 8*b*, 8*c*, and 8*d* of the cartridges 7*b*, 7*c*, and 7*d*, respectively, developers with magenta, cyan, and black colors, are stored, respectively.

The cleaning apparatus (6*a*, 6*b*, 6*c*, and 6*d*) is for removing (scraping down) the developer remaining on the peripheral surface of the photoconductive drum (1*a*, 1*b*, 1*c*, 1*d*) after the developer image formed on the peripheral surface of the photoconductive drum (1*a*, 1*b*, 1*c*, 1*d*) is transferred onto the recording medium S by the electrostatic transferring apparatus 5. The cleaning of the photoconductive drum (1*a*, 1*b*, 1*c*, 1*d*) by the cleaning apparatus makes the photoconductive drum ready for the next rotation for an image-formation process.

The electrostatic transferring apparatus 5 is provided with an electrostatic transfer belt 11 for conveying the recording medium S while electrostatically holding the recording medium S so that the recording medium S comes into contact with each of the plurality of the photoconductive drums (1*a*, 1*b*, 1*c*, 1*d*,), one by one. The electrostatic transferring apparatus 5 is also provided with a plurality of transfer rollers 12*a*, 12*b*, 12*c*, and 12*d* disposed in a manner to oppose the photoconductive drums 1*a*, 1*b*, 1*c*, and 1*d*, respectively, in order to sequentially transfer the developer images formed on the photoconductive drums 1*a*, 1*b*, 1*c*, and 1*d*, respectively, onto the recording medium S.

The transfer belt 11 is formed of film, the volume resistivity of which is in the range of $10^{11}$–$10^{14}$ Ω•cm. It circularly moves, remaining in contact with all of the photoconductive drums (1*a*, 1*b*, 1*c*, 1*d*). The transfer belt 11 in this embodiment is approximately 700 mm in circumference, and approximately 150 μm in thickness. It is suspended by a pair of follower rollers 14*a* and 14*b*, a tension roller 15, and a driver roller 13, and is circularly driven by the force from the driver roller 13 (in the direction of the arrow in FIG. 1). Disposed in a manner to oppose the follower roller 14*a*, that is, the follower roller on the bottom side, is an electrostatic adhesion roller 22, which is kept pressed on the outward surface of the transfer belt 11, being enabled to nip the recording medium S between itself and the transfer belt 11. As voltage is applied to between the transfer belt 11 and adhesion roller 22, electrical charge is induced between the recording medium S, which is dielectric, and the dielectric layer of the transfer belt 11, keeping thereby the recording medium S electrostatically adhered to the outward surface of the transfer belt 11.

The transfer roller (12*a*, 12*b*, 12*c*, 12*d*) is disposed at a position at which it opposes the corresponding photoconductive drum (1*a*, 1*b*, 1*c*, 1*d*), and is in contact with the inward surface of the transfer belt 11. As positive electric charge is applied to the recording medium S through the transfer belt 11, a developer image on the photoconductive drum, which is negative in polarity, is transferred by the electric field generated by the positive electric charge given to the recording medium S, onto the recording medium S in contact with the photoconductive drum.

The transfer belt 11 of the transferring apparatus 5 structured as described above adheres, in cooperation with the adhesion roller 22, the recording medium S to the outward surface of the transfer belt 11, on the left side of the circulative loop of the transfer belt 11, of the transferring apparatus, in FIG. 1, and circularly moves in a manner to place the recording medium S in contact with each of the photoconductive drums (1*a*, 1*b*, 1*c*, 1*d*). While the recording medium S is conveyed from the roller 14*a* side to the roller 13 side, the developer image on each of the photoconductive drums (1*a*, 1*b*, 1*c*, 1*d*) is transferred onto the recording medium S by the function of the transfer rollers (12*a*, 12*b*, 12*c*, 12*d*) opposing the photoconductive drums (1*a*, 1*b*, 1*c*, 1*d*), respectively.

A conveying portion 16 is a portion for conveying the recording medium S to the image forming portion. It comprises: a cassette 17, a conveying roller 18, and a registration roller pair 19. The cassette 17 holds a plurality of recording media S. During an image forming operation, the conveying roller 18 and registration roller pair 19 are rotationally driven in synchronism with the developer image-formation operation, whereby the plurality of the recording media S in the cassette 17 are sequentially conveyed into the image forming portion while being separated one by one. As the leading edge of each recording medium S comes into contact with the registration roller pair 19 while the registration roller pair 19 is not in motion, the recording medium S is temporarily stopped, being forced to temporarily curve. Then, the registration roller pair 19 is rotated to release the recording medium S onto the transfer belt 11 so that the arrival of the transfer-starting line of the recording medium S at the nip portion between the photoconductive drum and transfer roller synchronizes with the arrival of the leading edge of the developer image on the photoconductive drum at the nip portion.

A fixing portion 20 is for fixing a plurality of unfixed developer images, different in color, on the recording medium S, to the recording medium S. It comprises a rotational heat roller 21*a*, and a pressure roller 21*b* kept pressed upon the heat roller 21*a* to apply heat and pressure to the recording medium S. More specifically, while the recording medium S, onto which the plurality of developer images different in color have been transferred from the plurality of the photoconductive drums, one for one, is conveyed through the fixing portion 20, by the fixing roller pair 21 (21*a* and 21*b*), heat and pressure are applied by the fixing roller pair 21. As a result, the plurality of the developer images different in color are fixed to the surface of the recording medium S.

Next, the image forming process carried out by the image forming apparatus in accordance with the present invention will be described. After being mounted in the cartridge-mounting portions 30 (30*a*, 30*b*, 30*c*, 30*d*) (FIGS. 1, 2, and 3) of the apparatus main assembly 25, the process cartridges 7 (7*a*, 7*b*, 7*c*, 7*d*) are sequentially driven in synchronism with the developer image-formation timing. As they are driven, the photoconductive drums (1*a*, 1*b*, 1*c*, 1*d*) are rotationally driven in the counterclockwise direction, and the scanner units 3 (3*a*, 3*b*, 3*c*, 3*d*) opposing the cartridges (7*a*, 7*b*, 7*c*, 7*d*) one for one are sequentially driven.

Further, as the process cartridge (7*a*, 7*b*, 7*c*, 7*d*) is driven, the charging apparatus (2*a*, 2*b*, 2*c*, 2*d*) uniformly charges the peripheral surface of the corresponding photoconductive drum, and the uniformly charged peripheral surface of the photoconductive drum (1*a*, 1*b*, 1*c*, 1*d*) is exposed to the light projected by the unit 3 (3*a*, 3*b*, 3*c*, 3*d*) while being modulated with image-formation signals. As a result, an electrostatic latent image corresponding to a specific primary color component is formed on the peripheral surface of the photoconductive drum (1*a*, 1*b*, 1*c*, 1*d*). The development roller in the developing apparatus (4*a*, 4*b*, 4*c*, 4*d*) supplies the developer in the developer storage portion (8*a*, 8*b*, 8*c*, 8*d*) of the cartridge 7 (7*a*, 7*b*, 7*c*, 7*d*), to the developing portion, in which the developer is transferred onto the points of the peripheral surface of the photoconductive drum, which are lower in potential level. As a result, a visible image is formed of the developer, on the peripheral surface of the photoconductive drum (1*a*, 1*b*, 1*c*, 1*d*); in other words, the electrostatic latent image on the photoconductive drum (1*a*, 1*b*, 1*c*, 1*d*) is developed.

Meanwhile, the rotation of the registration roller pair 19 starts to release the recording medium S onto the transfer belt 11 so that the arrival of the leading edge of the developer image on the peripheral surface of the photoconductive drum 1*a*, that is, the most upstream photoconductive drum in terms of the recording medium conveyance direction, at a predetermined line in the nip portion between the transfer belt 11 and the transfer roller, synchronizes with the arrival of the transfer starting line of the recording medium S at the predetermined line in the nip portion.

As the recording medium S is conveyed by the transfer belt 11, it is pressed onto the outward surface of the transfer belt 11 by the adhesion roller 22, and voltage is applied between the transfer belt 11 and adhesion roller 22, ensuring that while the recording medium S is conveyed from the most upstream transfer station to the most downstream transfer station, it remains electrostatically adhered to the outward surface of the transfer belt 11.

As described above, the recording medium S is conveyed by the transfer belt 11. While the recording medium S is conveyed, the developer images, correspondent one for one to the primary color components, on the photoconductive drum 1*a*, the photoconductive drum 1*b*, the photoconductive drum 1*c*, and the photoconductive drum 1*d* are sequentially transferred onto the recording medium S by the electrical fields generated between the photoconductive drums (1*a*, 1*b*, 1*c*, 1*d*) and the transfer rollers (12*a*, 12*b*, 12*c*, 12*d*), respectively.

After the transfer of the developer images different in color onto the recording medium S, the recording medium S is separated from the transfer belt with the utilization of the curvature of the belt driving roller 13, and is conveyed into the fixing portion 20, in which the developer images are thermally fixed to the recording medium S by the heat roller 21*a* and pressure roller 21*b*. Thereafter, the recording medium S is discharged from the apparatus main assembly 25 through the outlet 24, by a discharge roller pair 23.

Meanwhile, the photoconductive drum (1*a*, 1*b*, 1*c*, 1*d*) is cleaned by the cleaning apparatus (6*a*, 6*b*, 6*c*, 6*d*); the residual developer, that is, the developer remaining on the peripheral surface of the photoconductive drum (1*a*, 1*b*, 1*c*, 1*d*), is scraped down by the cleaning apparatus (6*a*, 6*b*, 6*c*, 6*d*). The cleaned portion of the peripheral surface of the photoconductive drum is usable for the following image-forming process.

Next, the structure of the cartridge-mounting portion of the apparatus main assembly, the structure of a process cartridge removably mountable in the apparatus main assembly, and the method for removably mounting the process cartridge in the apparatus main assembly, will be described.

In consideration of the durability of the processing members, that is, the photoconductive drum, the charging device, the developing apparatus, the cleaning apparatus, etc., and the amount of the developer storable in the developer storage portion, the process cartridge 7 is structured so that it can be replaced with a new one as its cumulative usage reaches a predetermined usage amount. When the process cartridge 7 must be removed from the apparatus main assembly due to the expiration of one or a plurality of its processing members, or the depletion of the developer therein, or when a new process cartridge 7 is mounted into the apparatus main assembly, the cartridge 7 is moved, relative to the cartridge-mounting portion 30 of the apparatus main assembly 25, in a direction perpendicular to the axial line of the photoconductive drum.

Figure 2:
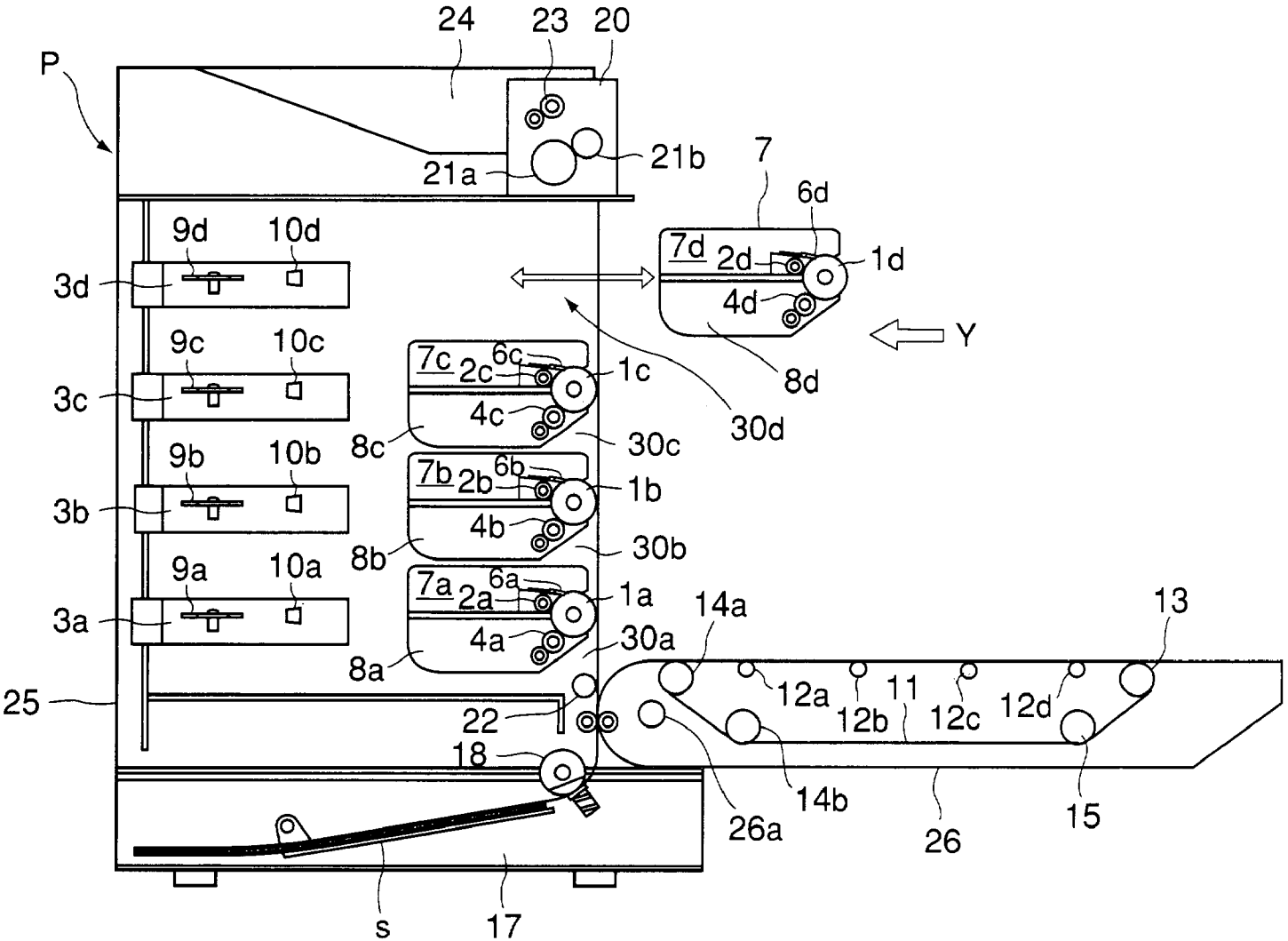
FIG. 2 is a vertical sectional view of an embodiment of an image forming apparatus in accordance with the present invention, in which a process cartridge in accordance with the present invention is removably mountable, and the front door of which is open.
Figure 3:
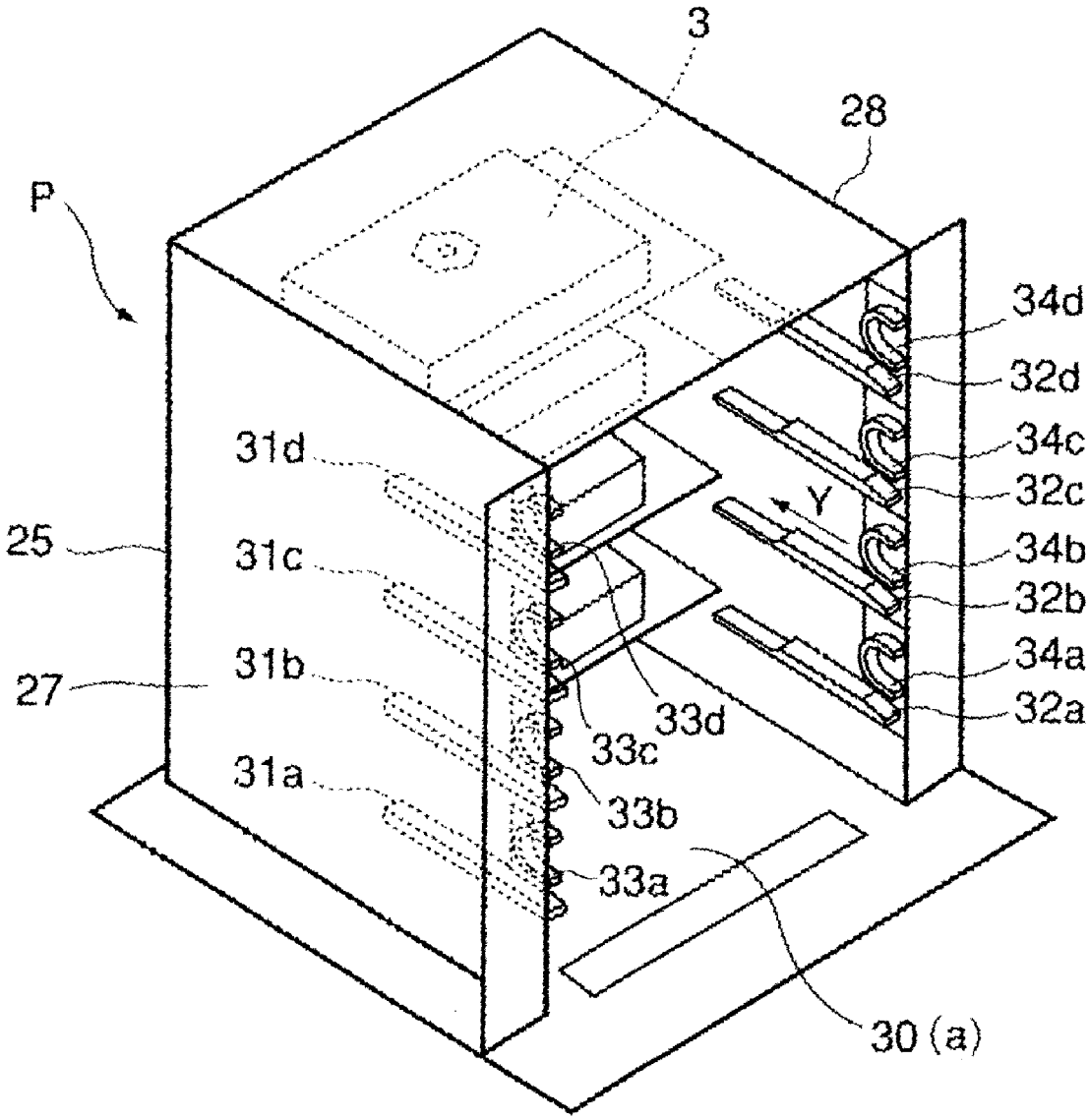
FIG. 3 is a schematic perspective view of the cartridge-mounting portion of the embodiment of an image forming apparatus in accordance with the present invention, in which a process cartridge in accordance with the present invention is removably mountable.

Referring to FIGS. 2 and 3, the apparatus main assembly 25 is provided with a cartridge entrance (opening) wider than the length of the cartridge 7 (the dimension of cartridge 7 in terms of lengthwise direction of photoconductive drum). It is also provided with a plurality (four in drawings) of cartridge-mounting portions 30 (30*a*, 30*b*, 30*c*, 30*d*). This cartridge entrance is provided with a front door 26, which is attached to the apparatus main assembly 25 so that it can be opened or closed by being rotated about a shaft 26*a*. To the front door 26, the transfer belt 11, transfer rollers (12*a*, 12*b*, 12*c*, 12*d*), the transfer belt support rollers 13–15, etc., of the transferring apparatus 5 are attached. Normally, the front door 26 is kept closed, as shown in FIG. 1, and is opened by an operator when mounting a process cartridge 7 for the first time, or replacing the process cartridge 7 with a new one (FIG. 2). As the front door 26 is opened, the transferring apparatus 5 is moved with the front door 26, exposing the cartridge-mounting portions 30.

Referring to FIG. 3, a first side wall 27 of the apparatus main assembly 25 is provided with a plurality (four in FIG. 4) of first guides 31 (31*a*, 31*b*, 31*c*, 31*d*) for guiding the cartridges 7 into the cartridge-mounting portions 30, and a second wall 28 of the apparatus main assembly 25 is provided with second guides 32 (32*a*, 32*b*, 32*c*, 32*d*) for guiding the cartridges 7 into the cartridge-mounting portions 30. The guides 31 (31*a*, 31*b*, 31*c*, 31*d*) are placed in parallel to each other, with equal intervals, and also, the guides 32 (32*a*, 32*b*, 32*c*, 32*d*) are placed in parallel to each other, with equal intervals. Designated by reference numerals 33 (33*a*, 33*b*, 33*c*, 33*d*) and 34 (34*a*, 34*b*, 34*c*, 34*d*) are first and second positioning portions for positioning the cartridges 7, and their details will be described later. Each cartridge-mounting portion 30 is provided with an elastic member (unshown), for example, a holding spring, for applying pressure upon the cartridge 7 to hold the cartridge 7 to a predetermined position. The elastic member may be of a type which presses on the top surface of the frame of the process cartridge 7 in the direction in which the process cartridge is mounted into the apparatus main assembly 25, or a type which presses the positioning potions of the process cartridge upon the counterparts of the apparatus main assembly 25.

As for the cartridge 7 (7*a*, 7*b*, 7*c*, 7*d*), referring to FIG. 4, the frame of the cartridge 7 is provided with a pair of handles 65, which are located at the ends of the cartridge frame in terms of its widthwise direction (lengthwise direction of photoconductive drum), and which project in the direction opposite to the cartridge-mounting direction. When the cartridge 7 is mounted into the cartridge-mounting portion 30 of the apparatus main assembly 25, the pair of handles 65 are grasped by the hands of an operator so that the process cartridge 7 can be horizontally inserted into the cartridge-mounting portion 30, following the guides 31 and 32 (FIG. 3) on the first and second side walls 27 and 28, respectively, of the apparatus main assembly 25, with the photoconductive drum being on the front side of the apparatus main assembly 25. Using this cartridge mounting method, each cartridge 7 is mounted into the corresponding cartridge-mounting portion 30 of the apparatus main assembly 25. After the mounting of the cartridge 7 into the cartridge-mounting portion 30 of the apparatus main assembly 25, the front door 26 is closed. As the front door 26 is closed, the process cartridges 7 are made to settle into predetermined positions by the pressure from the elastic members (unshown), that is, the pressing springs, and at the same time, the transfer belt 11 of the transferring apparatus 5 comes into contact with the photoconductive drum of each cartridge 7.

Next, the structures of the cartridge 7 and the apparatus main assembly 25, which are essential for precisely positioning the cartridge 7 relative to the apparatus main assembly 25 when mounting the cartridge 7 into the apparatus main assembly 25, will be described.

Figure 5:
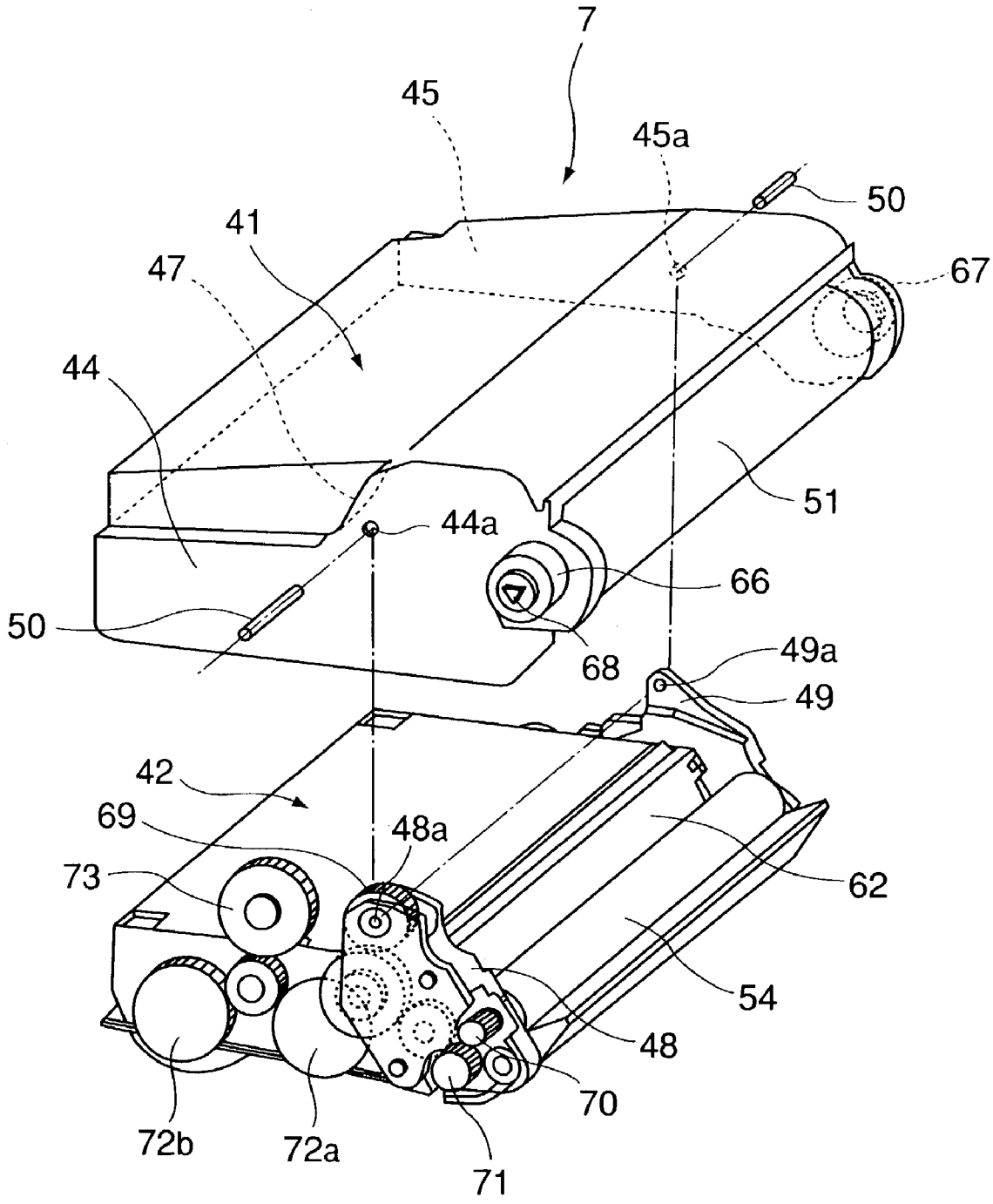
FIG. 5 is an exploded schematic perspective view of the embodiment of a process cartridge in accordance with the present invention.

Referring to FIGS. 4 and 5, this embodiment of a process cartridge in accordance with the present invention comprises a drum unit 41 as the top unit (first frame), and a development unit 42 as the bottom unit (second frame). The two units 41 and 42 are connected to each other so that they can be pivoted about a pair of pivots 43 as will be described later.

Referring to FIG. 5, the top unit (drum unit) 41 is provided with a first end cover 44 and a second end cover 45, which are located at the lengthwise ends of the drum unit 41, one for one. The first and second end covers 44 and 45 are provided with holes 44*a* and 45*a* for connecting the drum unit 41 to the development unit 42. The holes 44*a* and 45*a* correspond in position to the pivots 43, respectively. The photoconductive drum 51 (corresponding to photoconductive drum in FIG. 1) is rotationally supported by the first and second end covers 44 and 45 of the drum unit 41; the drum shaft 51A of the photoconductive drum 51 is rotationally supported by a pair of bearings 66 and 67 attached to the first and second end covers 44 and 45, respectively. Further, the drum unit 41 comprises: the charging member 52 (charge roller) of the charging apparatus; a cleaning member 56 (cleaning blade 56) of the cleaning apparatus; a removed developer storage portion 55 for storing the developer removed by the blade 56; and removed developer conveying means 57. The conveying means 57 comprises: a crank 57*a* rotationally disposed in the removed developer storage portion 55; and a removed developer conveying member 57*b* attached, like a connecting rod, to the crank pin portion of the crank. Thus, as the crank 57*a* rotates, the conveying member 57*b* is made to reciprocate, conveying the removed developer from the adjacencies of the blade 56 to the removed developer storage portion 55.

The bottom unit (development unit) 42 comprises: a developing member 54 (development roller) of the developing apparatus; a developing means holding frame 58; and a developer storage portion 59 (which corresponds to developer storage portion 8*a*, 8*b* in FIGS. 1 and 2) for storing a developer different in color from the developers in the other cartridges. The developer storage portion 59 is located under the removed developer storage portion 55, and is provided with a pair of stirring members 60*a* and 60*b*, which are disposed within the developer storage portion 55 and double as a developer-conveying mechanism. The developer T within the developer storage portion 59 is conveyed, while being stirred, by the pair of stirring members 60*a* and 60*b* to the developer supply roller 61 in the developing means holding frame 58. Then, the developer T is adhered to the peripheral surface of the development roller 54, by the developer supply roller 61, and the development blade 62 kept pressed upon the peripheral surface of the development roller 54, while being given an electric charge.

Referring to FIG. 5, the side walls (end walls in terms of lengthwise direction of development roller 54) of the bottom unit 42 are provided with a pair of extensions 48 and 49, one for one, for connecting the bottom unit 42 with the top unit 41. The extensions 48 and 49 are provided with through holes 48*a* and 49*a*, respectively, the axial lines of which correspond with the axial lines of the pivots 43. Through these through holes 48*a* and 49*a*, and the holes 44*a* and 45*a* of the top unit 41, a pair of positioning pins 50 (pivots 43) are inserted, one for one, from outward of the cassette 7, so that the top unit 41 and the bottom unit 42 are connected to each other, being enabled to pivot about the positioning pins 50, as shown in FIG. 4.

Further, a pair of pressing springs 63 are disposed between the units 41 and 42, at the left and right corners of the leading end portions of the two unit, in terms of the cartridge-inserting direction. Therefore, the development roller 54 is kept pressed upon the peripheral surface of the photoconductive drum while being allowed to orbitally move about the positioning pins 50 (pivots 43), ensuring that the photoconductive drum 51 and the development roller 54 are kept in contact with each other across their lengthwise ranges. Referring to FIG. 4, a reference numeral 64 stands for an exposure opening, which is provided between the top unit 41 and the bottom unit 42, and through which an optical image is projected from the scanner unit 3 onto the photoconductive drum 51 to form a latent image on the photoconductive drum 51.

Next, the mechanism for transmitting a driving force to the cartridge 7 will be described. In this embodiment, the force for driving the cartridge 7 is transmitted from the apparatus main assembly 25 directly to both the top unit 41 and the bottom unit 42 of the cartridge 7.

Referring to FIG. 5, the photoconductive drum 51 is rotationally supported by the first and second end covers 44 and 45 of the top unit 41, with the interposition of the pair of bearings 66 and 67, respectively. Further, the photoconductive drum 51 is provided with a coupling 68, as a member for the photoconductive drum 51 to receive driving force from the apparatus main assembly 25, which is attached to one end of the drum shaft 51A, whereas the apparatus main assembly 25 is provided with a coupling 100 (FIGS. 12 and 13, etc.) as a member for transmitting the driving force from the apparatus main assembly 25 to the photoconductive drum 51. With the provision of this structural arrangement, the force for driving the photoconductive drum 51 is transmitted from the apparatus main assembly 25 to the coupling 68 on the cartridge side. The coupling 68 on the cartridge side (which hereinafter will be referred to as the cartridge coupling) is in the form of a twisted column, the cross section of which is in the form of an approximately equilateral triangle, whereas the coupling 100 on the apparatus-main-assembly side (which hereinafter will be referred to as main-assembly coupling) is a member with a hole in the form of a twisted column, the cross section of which is in the form of an approximately equilateral triangle. The main assembly coupling 100 engages with the cartridge coupling 68 in the direction parallel to the lengthwise direction of the photoconductive drum 51. As the main assembly coupling 100 begins to be rotated, the cartridge coupling 68 is gradually drawn into the main assembly coupling due to the twist of the cartridge coupling 68, and the twist of the hole of the main assembly coupling, and fully engages with the cartridge coupling 68 by the time it is rotated 120°. In other words, driving force is transmitted to the photoconductive drum 51 through the cartridge coupling 68.

The bottom unit 42 is provided with a gear 69, as a member (f) for receiving the force for driving the development roller 54, which is attached to the extension 48 of the bottom unit 42, that is, the extension on the side from which the process cartridge 7 is driven. The gear 69 is a helical gear. To the gear 69, a driving force is transmitted from a helical gear 69C (FIG. 6), as a member, on the apparatus-main-assembly side, for transmitting the force for driving the development roller 54 (which hereinafter may be referred to as driving force transmitting main assembly member). The gear 69 is disposed at the same lengthwise end of the cartridge 7 as the cartridge coupling 68. In terms of the direction in which the cartridge 7 is mounted into the apparatus main assembly 25, the gear 69 is disposed on the downstream side with respect to the cartridge coupling 68, and in terms of the direction perpendicular to the cartridge-mounting direction, the gear 69 is disposed on the inward side with respect to the cartridge coupling 68.

The axial line of the gear 69 coincides with the axial line of the through hole 48*a*, the axial line of which coincides with the axial line of each of the pivots 43. Thus, the axial line of the gear 69 coincides with the axial line of each of the positioning pins 50 (pivots 43) connecting the top unit 41 and bottom unit 42. The gear 69 is partially exposed at the gear exposure opening of the first end cover 44 of the top unit 41, and meshes, by the portion exposed from the gear exposure opening, with the helical gear 69C, functioning as the development roller driving force transmitting member on the apparatus-main-assembly side. In terms of the direction in which the cartridge 7 is mounted, the gear 69C with which the gear 69 meshes is disposed on the downstream side with respect to the center of the gear 69, being attached to the apparatus main assembly 25.

The driving force transmitted to the gear 69, functioning as the development roller driving force receiving member, is transmitted to the development roller 54, the stirring members 60*a* and 60*b*, as well as the removed developer conveying means 55 of the top unit 41, in a bifurcating manner, through a gear train. More specifically, the driving force received by the gear 69 is transmitted to a development roller gear 70 attached to the lengthwise end of the development roller 54, and a gear 71 attached to the lengthwise end of the developer supply roller 61, through idler gears, rotating the development roller 54 and developer supply roller 61, respectively. The idler gears are configured so that they function as a driving speed reducing means. They are meshed with the developer stirring gears 72*a* and 72*b* of the stirring members 60*a* and 60*b*, respectively. Therefore, the stirring members 60*a* and 60*b* are rotated by the driving force transmitted, in a bifurcating manner, through the idler gears. The idler gears are also connected, through an idler gear 73, to a gear (unshown) attached to the crank 57*a* of the removed developer conveying means 57 of the top unit 41, transmitting thereby the driving force to the crank 57*a* and the removed developer conveying member 57*b*. In other words, after being inputted into the aforementioned gear 69 of the bottom unit 42, the driving force drives the development roller 54, the stirring members 60*a* and 60*b*, etc., in the bottom unit 42. Further, it drives the removed developer conveying means 57 in the top unit 41.

Next, the structure for ensuring that the cartridge 7 is precisely positioned relative to the apparatus main assembly 25 will be described.

Figure 6:
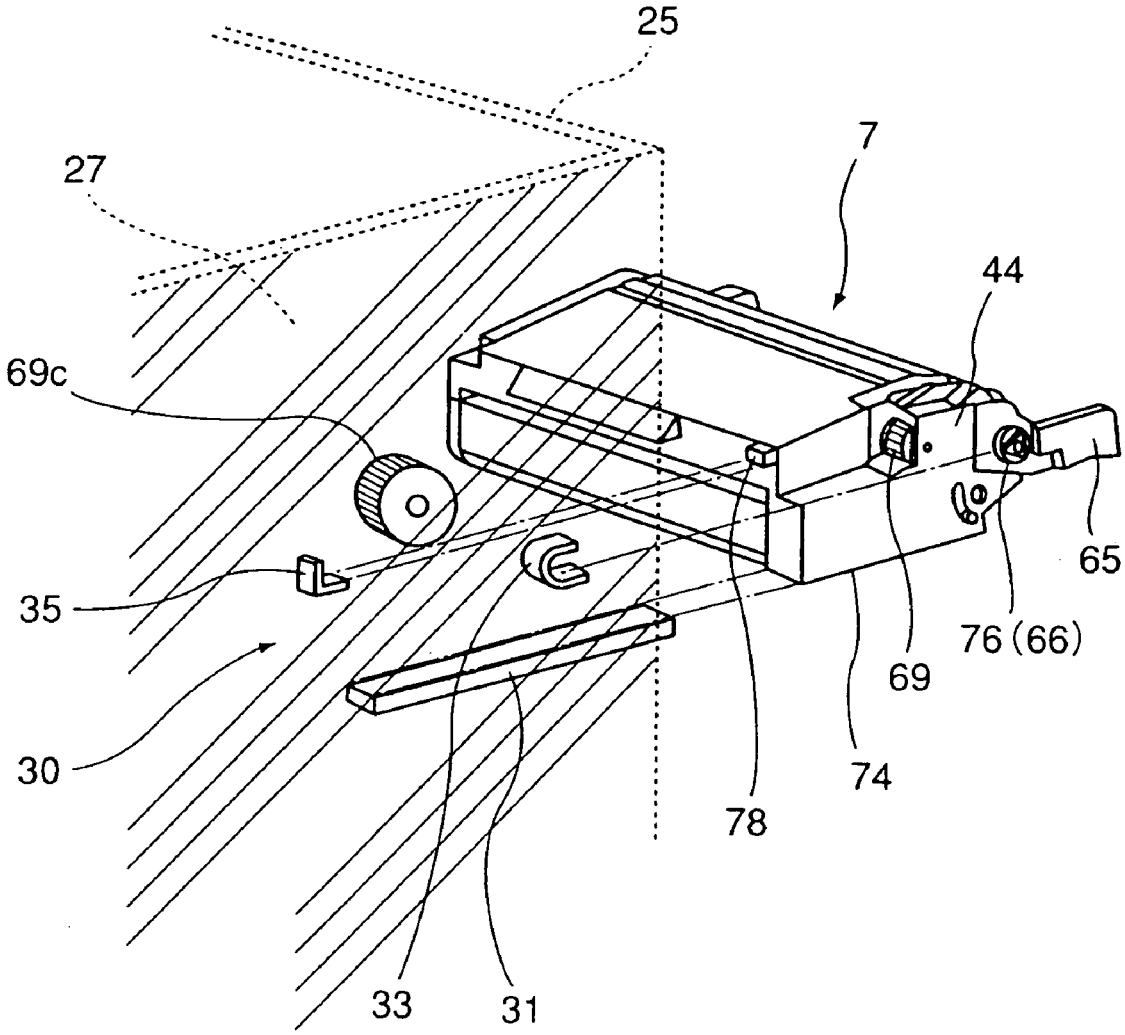
FIG. 6 is a schematic perspective view of the embodiment of a process cartridge in accordance with the present invention, as seen from the diagonally left direction in terms of the direction in which the process cartridge is inserted into the main assembly of an image forming apparatus in accordance with the present invention, for showing how the process cartridge is positioned relative to the apparatus main assembly.
Figure 7:
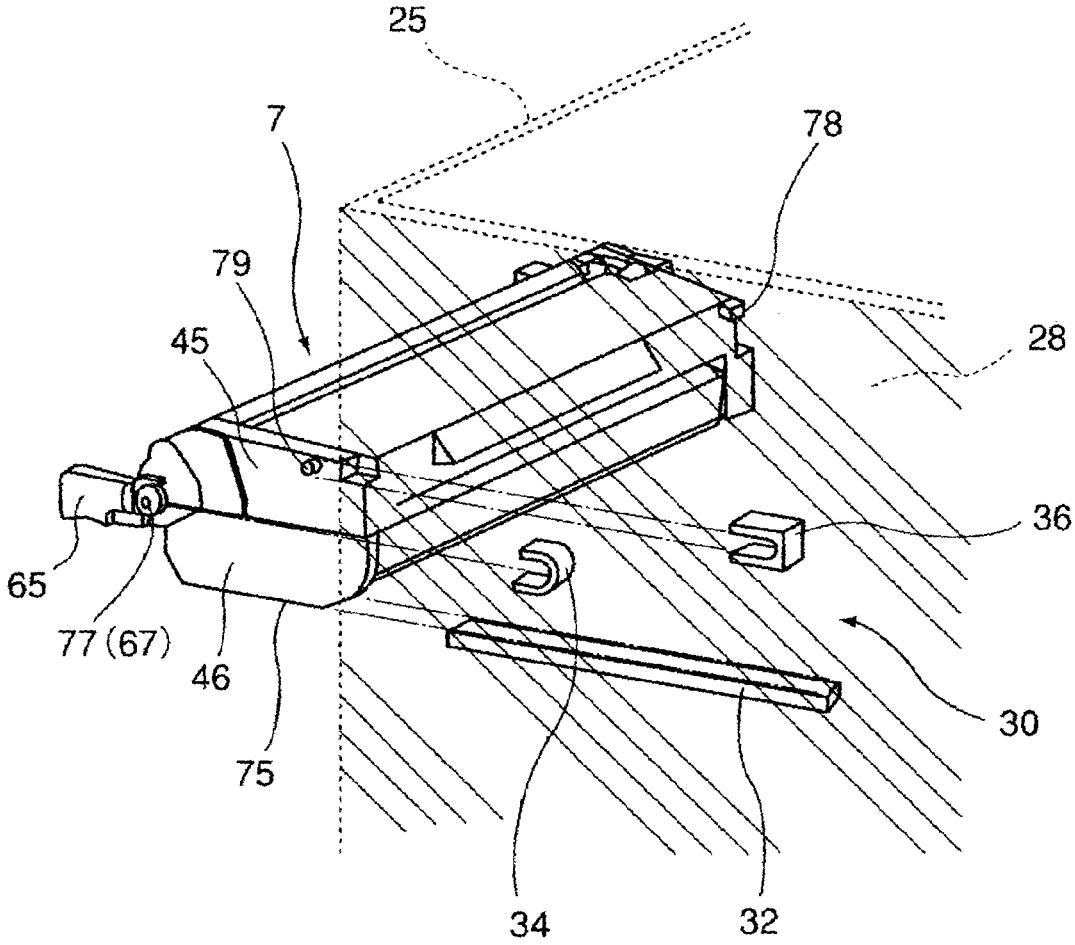
FIG. 7 is a schematic perspective view of the embodiment of a process cartridge in accordance with the present invention, as seen from the diagonally right direction in terms of the direction in which the process cartridge is inserted into the main assembly of an image forming apparatus in accordance with the present invention, for showing how the process cartridge is positioned relative to the apparatus main assembly.

The first and second end covers 44 and 45 of the cartridge 7 are disposed at the lengthwise ends of the cartridge 7, one for one, so that they become parallel to the first and second side walls 27 and 28, respectively, of the apparatus main assembly 25, when the cartridge 7 is properly mounted in the apparatus main assembly 25 (FIGS. 3, 5, and 7). The first and second side walls 27 and 28 of the apparatus main assembly 25 are provided with the first and second sets of guides, respectively, for guiding the cartridge 7 into the cartridge-mounting portion 30 when the cartridge 7 is mounted into the apparatus main assembly 25. The cartridge 7 is provided with the first and second guides 74 and 75, which are at the lengthwise ends, one for one, of the bottom surface, and which are guided by one of the first set of guides 33, and the corresponding guide of the second set of guides 34, of the apparatus main assembly 25, respectively. The first guide 74 of the cartridge 7 is a part of the bottom portion of the first end cover 44 (that is, side wall of the top unit 41) of the cartridge 7 (FIG. 6), and the second guide 75 of the cartridge 7 is a part of the bottom portion of the second end cover 45, that is, the bottom portion of the side wall 46 of the bottom unit 42 (FIG. 7).

Therefore, when the cartridge 7 is mounted into the cartridge-mounting portion 30 of the apparatus main assembly 25, the first guide 74 of the cartridge 7 is guided by the first guide 31 of the first side wall 27 of the apparatus main assembly 25, and the second guide 75 of the cartridge 7 is guided by the second guide 32 of the second side wall 28 of the apparatus main assembly 25.

Referring to FIGS. 6 and 7, in order to position the cartridge 7 relative to the cartridge-mounting portion 30, the cartridge-mounting portion 30 is provided with a first positioning portion 33, a second positioning portion 34, and a third positioning portion 35, whereas the cartridge 7 is provided with a first positioning portion 76, a second positioning portion 77, and a third positioning portion 78.

The first positioning portion 76 of the cartridge 7 is positioned so that its axial line coincides with that of the photoconductive drum 51 in the cartridge 7. It projects outward from the first end cover 44 of the cartridge 7 in the lengthwise direction of the photoconductive drum 51. The second positioning portion 77 of the cartridge 7 is similar to the first positioning portion 76 of the cartridge 7. That is, its axial line coincides with that of the photoconductive drum 51 in the cartridge 7. It projects outward from the second end cover 45 of the cartridge 7 in the lengthwise direction of the photoconductive drum 51. In this embodiment, the bearings 66 and 67 of the first and second end covers 44 and 45 are utilized as the first and second positioning portions 76 and 77, respectively. In other words, the dimension of the cartridge 7 is reduced by making the portions for rotationally supporting the photoconductive drum 51 double as the portions for positioning the cartridge 7. The bearings 66 and 67 are attached to the end covers 44 and 45, respectively, and rotationally support the drum shaft 51A of the photoconductive drum 51. The first and second positioning portions 76 and 77 of the cartridge 7 are positioned by the first and second positioning portions 33 and 34 of the apparatus main assembly 25, respectively, as the cartridge 7 is mounted into the cartridge-mounting portion 30 of the apparatus main assembly 25. The first and second positioning portions 33 and 34 of the apparatus main assembly 25 are attached to the first and second side walls 27 and 28 of the apparatus main assembly 25.

Positioning of the first and second positioning portions 76 and 77 by the counterparts on the apparatus-main-assembly 25 side, alone, cannot prevent the cartridge 7 from being rotated by the moment generated as a driving force is transmitted to the development roller 54 (developing member) from the apparatus main assembly 25 to rotate the development roller 54. Therefore, in order to deal with this problem, the cartridge 7 is provided with the projecting third positioning portion 78, which is on the downstream side with respect to the first positioning portion 76, in terms of the cartridge-mounting direction Y (FIGS. 1, 2 and 3), and which projects in the downstream direction from the first end cover 44 in parallel to the lengthwise direction of the cartridge 7, as shown in FIG. 6. Correspondingly, the apparatus main assembly 25 is provided with the third positioning portion 35, which is attached to the first side wall 27 to catch the third positioning portion 78. The third positioning portion 78 of the cartridge 7 is desired to be projecting, and also, is desired to be molded as an integral part of the first end cover 44 formed of a resinous substance. In terms of the cartridge-mounting direction Y, the development roller driving force receiving portion 69, which is a helical gear, is disposed between the third and first positioning portion 78 and 76, being partially exposed from the first end cover 44 (FIG. 6). Further, the third positioning portion 78 is disposed at a level below the path which the development roller driving force receiving portion 69 follows when the development roller driving force receiving portion 69 is moved in the cartridge-mounting direction Y to be engaged with the development roller driving force transmitting member 69*c* of the apparatus main assembly 25. Further, in terms of the lengthwise direction of the cartridge 7, the projecting third positioning portion 78 of the cartridge 7, the developer roller driving force receiving portion 69 in the form of a helical gear, and the first positioning portion 76 of the cartridge 7, which doubles as the bearing 66 for rotationally supporting the drum shaft 51A of the photoconductive drum 51, are disposed in the mentioned order, listing from the inward to outward direction (FIG. 6).

Further, referring to FIG. 7, the process cartridge 7 is provided with the third guide 79, in addition to the first and second guides 74 and 75, as the guide for guiding the cartridge 7 during the mounting of the cartridge 7. The third guide 79 is disposed on the downstream side with respect to the second positioning portion 77 in terms of the cartridge-mounting direction Y. In terms of the vertical direction, the third guide 79 is disposed at a level higher than the third positioning portion 78. It projects outward from the second end cover 45 of the cartridge 7 in the lengthwise direction of the photoconductive drum 51. It is a cylindrical member formed of a resinous substance, and is molded as an integral part of the resinous second end cover 45. Further, it is guided by a third guide 36 of the apparatus main assembly 25 when the cartridge 7 is mounted into the apparatus main assembly 25.

Figure 8:
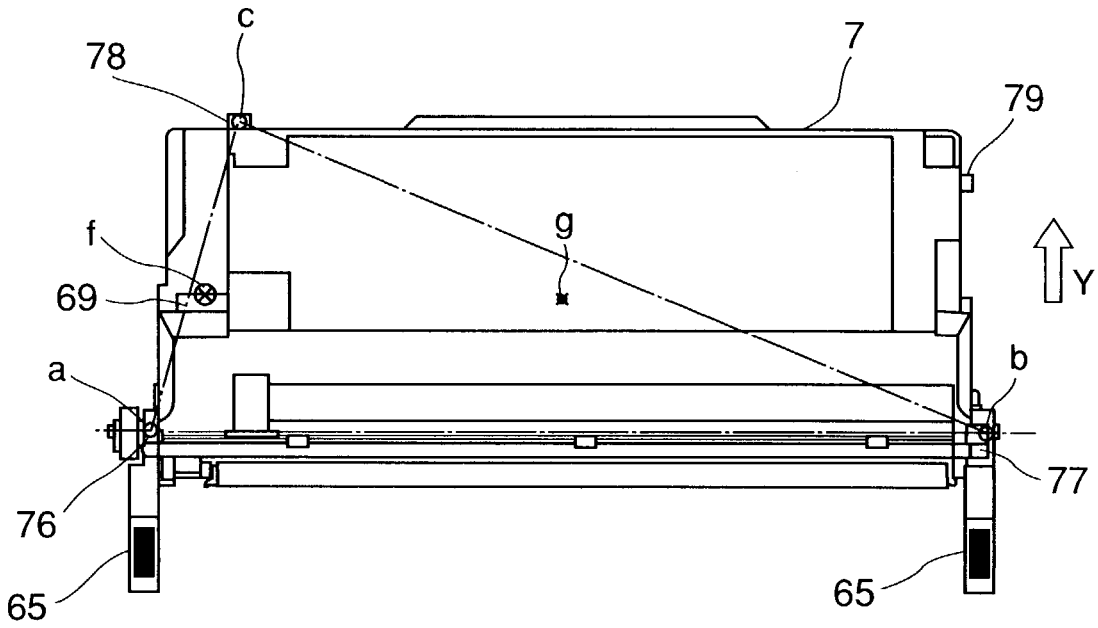
FIG. 8 is a top plan view of the embodiment of a process cartridge in accordance with the present invention, for showing how the process cartridge is supported in an image forming apparatus in accordance with the present invention.

Referring to FIGS. 6 and 7, with the provision of the above-described structural arrangement, not only is the process cartridge 7 supported by the first, second, and third positioning portions 76, 77, and 78, but also it is positioned by them, in the cartridge mounting portion 30 of the apparatus main assembly 25. In other words, the position of the cartridge 7 relative to the cartridge-mounting portion 30 is fixed by three points (a, b, and c) as shown in FIG. 8. Also in FIG. 8, the points a and b are the contact points between the bearings 66 and 67 as the first and second positioning portions 76 and 77 of the cartridge 7, and the first and second positioning portions 33 and 34 of the apparatus main assembly 25, respectively. In this embodiment, they coincide, one for one, with the intersection of the axial line of the drum shaft 51A of the photoconductive drum 51, and the plane which bisects the bearing 66 in terms of its widthwise direction, and the intersection of the axial line of the drum shaft 51A of the photoconductive drum 51, and the plane which bisects the bearing 67 in terms of its widthwise direction. The point c is the contact point between the third positioning portion 78 projecting from the cartridge 7 and the third positioning portion 35 of the apparatus main assembly 25. In this embodiment, it coincides with the center of the intersection of the plane which bisects the third positioning portion 78 in terms of its projecting direction, and the plane which bisects the third positioning portion 78 in terms of the direction perpendicular to its projecting direction. The point f coincides with the intersection of the addendum circle (FIG. 8) of the gear 69 (development roller driving force receiving portion), and the plane which halves the gear 69 in terms of its width direction. Further, in this embodiment, the points a, b, and c have only to be the contact points between the first, second, and third positioning portions 76 (66), 77 (67), and 78 of the cartridge 7, and the first, second, and third positioning portions 33, 34, and 35 of the apparatus main assembly 25, respectively, and they do not need to coincide with the above-described specific points.

Therefore, the development roller driving force receiving point (f) falls within the triangular area bordered by the lines connecting the three points (a, b, and c), as shown in FIG. 8. With the provision of this structural arrangement, the cartridge 7 is kept stable in attitude even while the cartridge 7 is driven. Further, the cartridge 7 is positioned with a high degree of reliability and precision, while employing a simple structural arrangement. Further, the loads which act on the first and second positioning portions 76 (a) and 77 (b) can be substantially reduced or virtually eliminated. Further, in this embodiment, the center of gravity (g) of the cartridge 7 also falls within the above-described triangular area, as does the developer roller driving force receiving point (f), enhancing the above-described effects of the present invention.

Further, in this embodiment, the third positioning portion 78 of the cartridge 7 is positioned on the downstream side with respect to the first positioning portion 76 of the cartridge 7 in terms of the cartridge-mounting direction, and is in the form of a projection projecting downstream in terms of the cartridge-mounting direction, from the first end cover 44 of the cartridge 7 in the lengthwise direction of the cartridge 7. Therefore, the cartridge 7 is precisely positioned, and is kept stable in attitude, with the use of the simple structural arrangement, without unnecessarily increasing the size of the cartridge 7 in terms of its lengthwise direction. Further, it is possible to reduce the sizes of the apparatus main assembly 25 and the cartridge 7.

Figure 9:
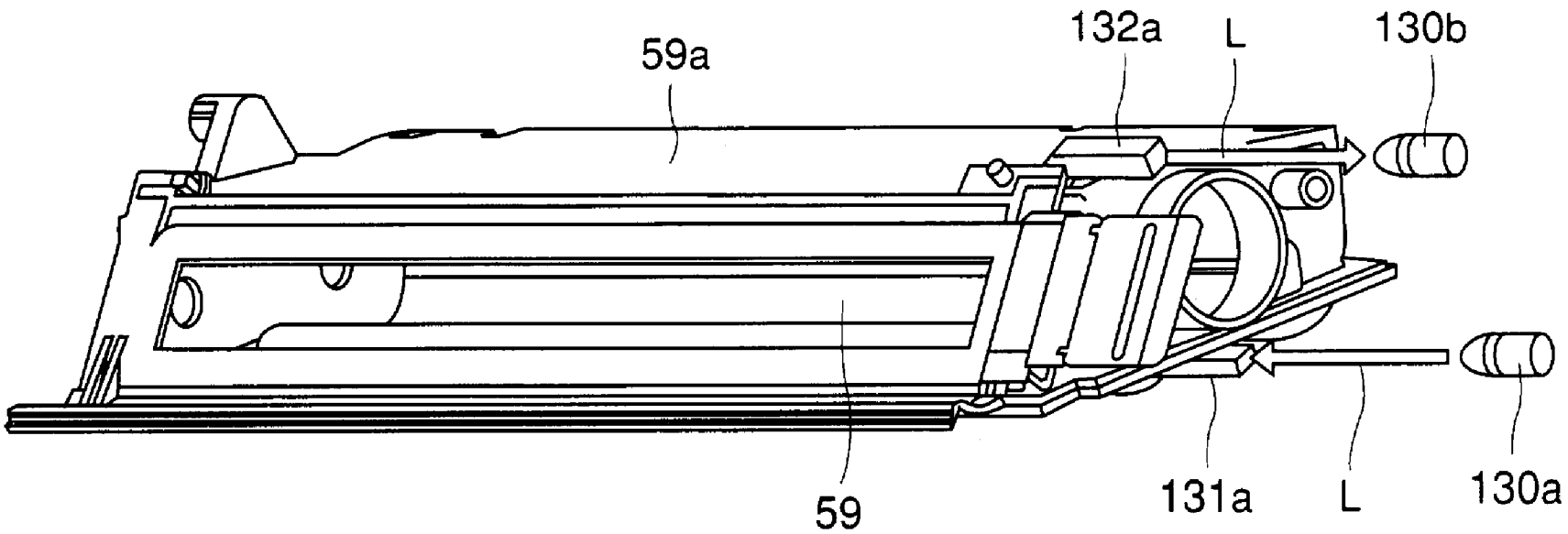
FIG. 9 is a perspective view of the developer storage portion, for showing the developer remainder amount detecting means for detecting the amount of the developer in the developer storage portion of the embodiment of a process cartridge in accordance with the present invention.
Figure 10:
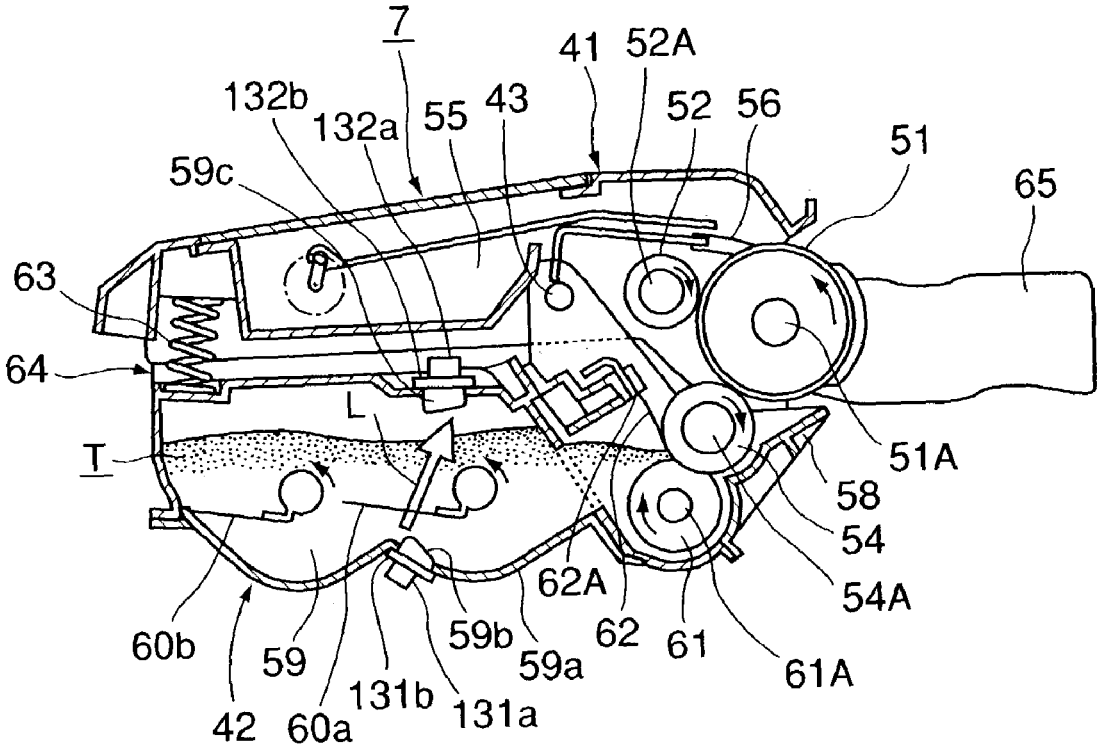
FIG. 10 is a sectional view of the embodiment of a process cartridge in accordance with the present invention, at a plane, which is perpendicular to the lengthwise direction of the process cartridge and intersects the developer remainder amount detecting means.

Next, referring to FIGS. 9 and 10, an embodiment of a developer remainder amount detecting means for detecting the amount of the developer T remaining in the developer storage portion of a process cartridge will be described. FIG. 9 is a perspective view of the developer storage frame, for showing the developer remainder amount detecting means for detecting the amount of the developer T remaining in the developer storage portion of a process cartridge in accordance with the present invention. FIG. 10 is a sectional view of the developer remainder amount detecting means, and its adjacencies, of the process cartridge, at a plane which is perpendicular to the lengthwise direction of the process cartridge and intersects the developer remainder amount detecting means.

Referring to FIG. 10, a developer storage frame 59*a*, also called sub-frame 59*a*, which constitutes the shell portion of the developer storage portion 59, in which the developer T is stored, has a pair of transparent windows (openings) 59*b* and 59*c*, through which a light beam L for detecting the amount of the remaining developer is passed through the developer storage portion 59. The windows 59*b* and 59*c* are in one of the lengthwise end walls of the developer storage portion 59, and their positions correspond to the bottom and top ends of the developer storage frame 59*a*, respectively. The bottom transparent window 59*b* has a light guide 131*a* for guiding the developer detecting light beam L into the developer storage portion 59. The light guide 131*a* is attached to the external surface of the bottom wall of the sub-frame 59*a*, with the interposition of a guide 131*b*. The light guide 131*a* extends in the lengthwise direction of the developer storage frame 59*a*, but its lengthwise ends do not extend to the corresponding lengthwise ends of the bottom unit 42. In other words, the lengthwise ends of the light guide 131*a* are on the slightly inward side of the corresponding lengthwise ends of the bottom unit 42; the light guide 131*a* does not extend beyond the lengthwise ends of the bottom unit 42. The top transparent window 59*c* has a light guide 132*a* for receiving the developer detecting light beam L which comes through the internal space of the developer storage portion 59. The light guide 132*a* is attached to the external surface of the top wall of the developer storage frame 59*a*, with the interposition of a guide 132*b*, extending in the lengthwise direction of the developer storage frame 59*a*. More specifically, the light guide 132*a* is within the space between the bottom and top units 42 and 41, being at the lever lower than the level of the path of the laser beam projected onto the photoconductive drum 51. The lengthwise ends of the light guide 132*a* are on the slightly inward side of the corresponding lengthwise ends of the bottom unit 42; the light guide 132*a* does not extend beyond the lengthwise ends of the bottom unit 42.

Referring to FIG. 9, a light emitting element 130*a* which emits the developer detection light beam L for detecting the amount of the remainder of the developer T in the developer storage portion 52, and a light receiving element 130*b* which receives the developer detection light beam L as the light beam L passes the internal space of the developer storage portion 59, are on the second side wall 28 of the apparatus main assembly 25, so that they will be next to the side wall of the developer storage frame 59*a* when the process cartridge 7 is in the proper position in the cartridge-mounting portion 30. The developer storage frame 59*a* contains first and second stirring members 60*a* and 60*b*, which convey the developer T to the developer supply roller 61 while stirring the developer T. The first stirring member 60*a*, that is, the stirring member closer to the development roller 54, has the function of wiping the developer adhering to the surfaces of the top and bottom transparent windows 59*b* and 59*c*, in addition to the function of conveying the developer T.

With the provision of the above-described structural arrangement, the developer detection light beam L emitted from the light emitting element 130*a* travels through the light guide 131*a*, is refracted upward by the guide 131*b*, and enters the developer storage portion 59 in the developer storage frame 59*a* through the bottom transparent window 59*b*. Then, the light beam L travels through the internal space of the developer storage portion 59, reaching the top transparent window 59*c* which opposes the bottom transparent window 59*b*, enters the guide 132*b* of the light guide 132*a*, being refracted thereby, and reaches the light receiving element 130*b* by way of the light guide 132*a*. Thus, the amount of the developer T remaining in the developer storage portion 59 is determined based on the length of the time the light receiving element 130*b* receives the developer detecting light beam L. The light emitting element 130*a* and light receiving element 130*b* are on the bottom and top sides of one of the side walls of the image-forming apparatus main assembly 25.

The ratio of the length of time the light receiving element 130*b* receives the light beam L varies in proportion to the amount of the developer T in the developer storage portion 59. However, when a certain ratio of the internal space of the developer storage portion 59 is occupied by the developer T, the developer detection light beam L having entered the developer storage portion 59 through the light guide 131*a* is blocked by the developer T, failing to reach the light guide 132*a*. Therefore, the light receiving element 130*b* does not receive the light beam L at all. Then, as the amount of the developer T in the developer storage portion 59 is reduced, the ratio of the length of time the developer detection light beam L is allowed to travel between the light guides 131*a* and 132*a* as the developer T is stirred by the first stirring member 60*a* gradually increases. This makes it possible to know the amount of the developer T remaining in the developer storage portion 59.

With the provision of the above-described structural arrangement, it is possible to continuously know the developer T remaining in the developer storage portion 59, based on the changes in the length of time the light receiving element 130*b* receives the developer detection light beam L. Further, it is possible to inform a user of the condition that the developer storage portion 59 is about to run out of the developer T.

Next, referring to FIGS. 11 and 19, the electrical contacts for establishing an electrical connection between the process cartridge 7 and the main assembly 25 of the image forming apparatus P as the former is mounted into the latter, will be described regarding their structures.

Figure 11:
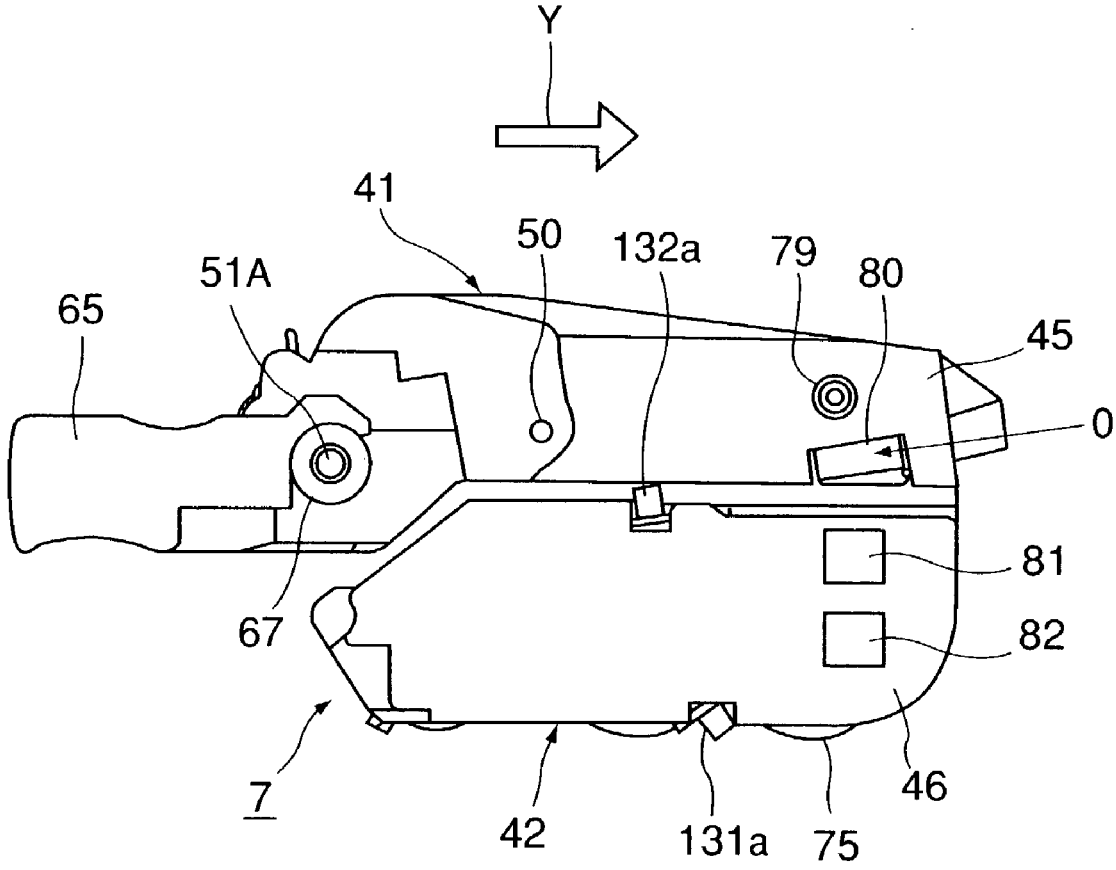
FIG. 11 is a side view of the embodiment of a process cartridge in accordance with the present invention.
Figure 19:
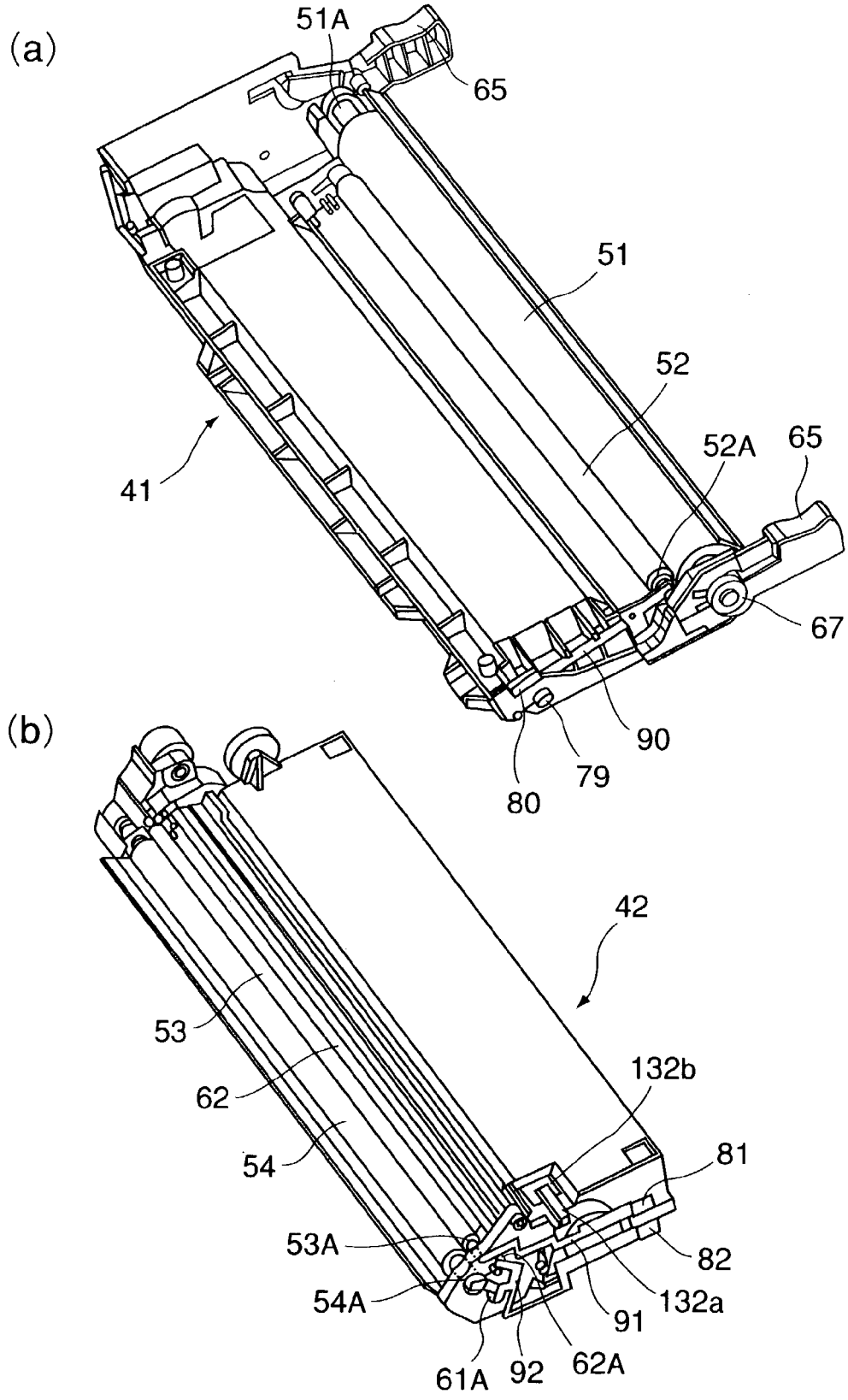
FIG. 19(*a*) is an external perspective view of the reversely placed top unit of the embodiment of a process cartridge in accordance with the present invention, and FIG. 19(*b*) is an external perspective view of the bottom unit of the same cartridge.

Referring to FIG. 11, the process cartridge 7 has four electrical contacts 80–83, which are:

1) electrically conductive charge bias contact (first electrical contact) 80 electrically connected to the charge roller shaft 52A to apply charge bias from the image forming apparatus P to the charge roller 52, as a photoconductive member charging member;
2) electrically conductive developer charge bias contact (second electrical contact) 81 electrically connected to the developer charge roller shaft 53A (FIG. 19(*b*)) to apply developer charge bias to the developer charge roller 53, as a developer charging member (FIG. 19(*b*)), from the image forming apparatus P, in order to charge the developer T; and
3) electrically conductive developer bias contact (third electrical contact) 82 electrically connected to the development roller shaft 54A, the developer supply roller shaft 61A, and development blade supporting member 62A to apply a development bias to the development roller 54 as a developing member, the developer supply roller 61 as a developer supplying member, and the development blade 62 as a regulating member, respectively, from the image forming apparatus P.

These electrical contacts 80–82 are exposed from the right side (second end cover 45 of top unit 41, and side wall 46 of bottom unit 42) of the cartridge frame; they all are at the same lengthwise end of the cartridge frame, being separated from each other by a distance large enough to prevent an electrical leak. In addition, the process cartridge 7 has: 4) an electrically conductive ground contact (fourth electrical contact) 83, which is electrically connected to the photoconductive drum 51 to ground the photoconductive drum 51 to the apparatus main assembly 25 of the image forming apparatus P, and which is on the cartridge coupling 68 for receiving the force for rotationally driving the photoconductive drum 51 from the apparatus main assembly 25, protruding from the center of the end surface (left end surface) of the cartridge coupling 68.

In this embodiment, the electrically conductive ground contact 83 is an integral part of the drum shaft 51A, and is formed of a metallic substance, such as iron. Other contacts 80, 81, and 82 are strips of electrically conductive metallic plate with a thickness of approximately 0.1 mm–0.3 mm, and are intricately routed within the process cartridge. The charge bias contact 80 is exposed from the second end cover 45, that is, the side wall of the top unit (drum unit) 41, on the side from which the process cartridge 7 is not driven (which hereinafter will be referred to as non-driven side). The developer charge bias contact 81 and the development bias contact 82 are exposed from the side wall 46 of the bottom unit (development unit) 42, on the non-driven side.

Figure 12:
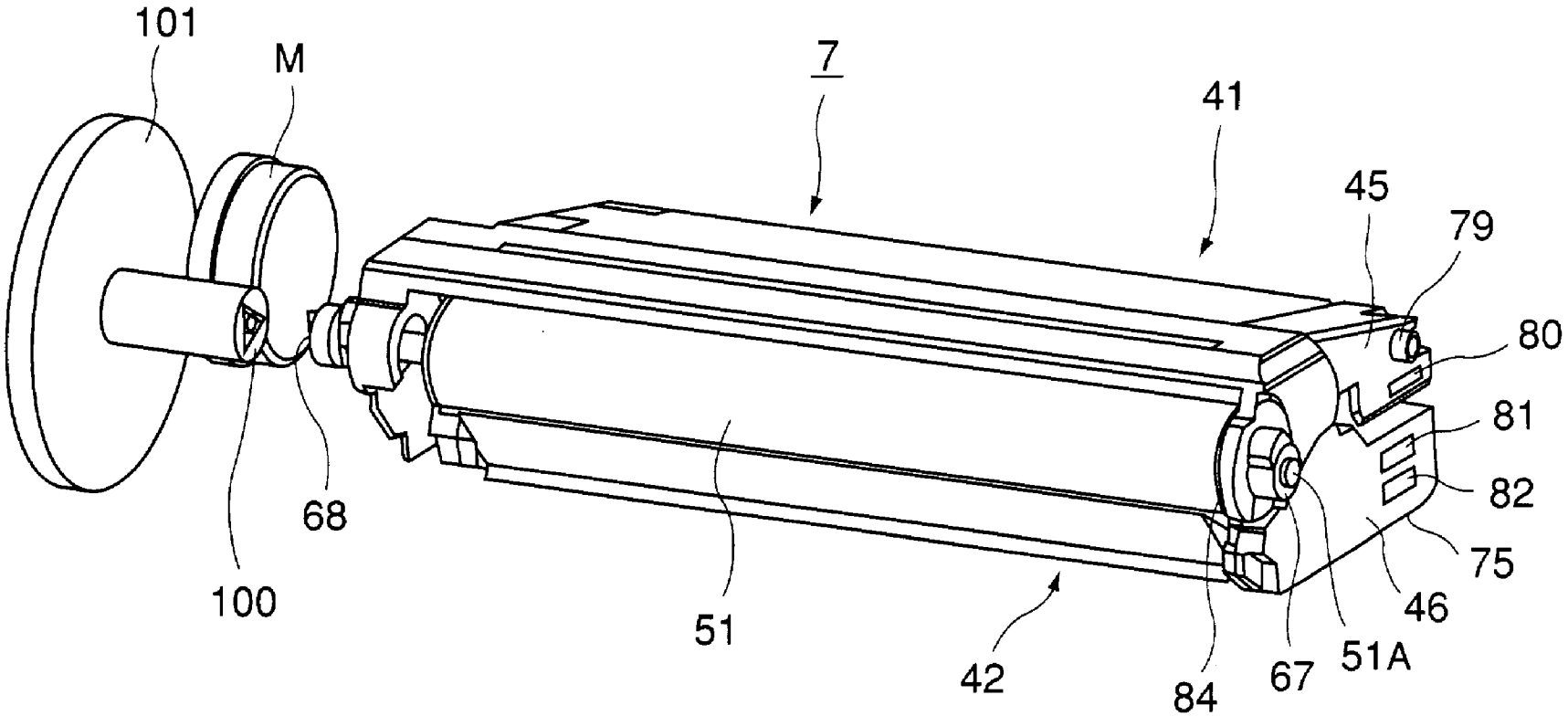
FIG. 12 is a schematic perspective view of the driving force transmitting mechanism for transmitting a driving force to the photoconductive drum in the embodiment of a process cartridge in accordance with the present invention.
Figure 13:
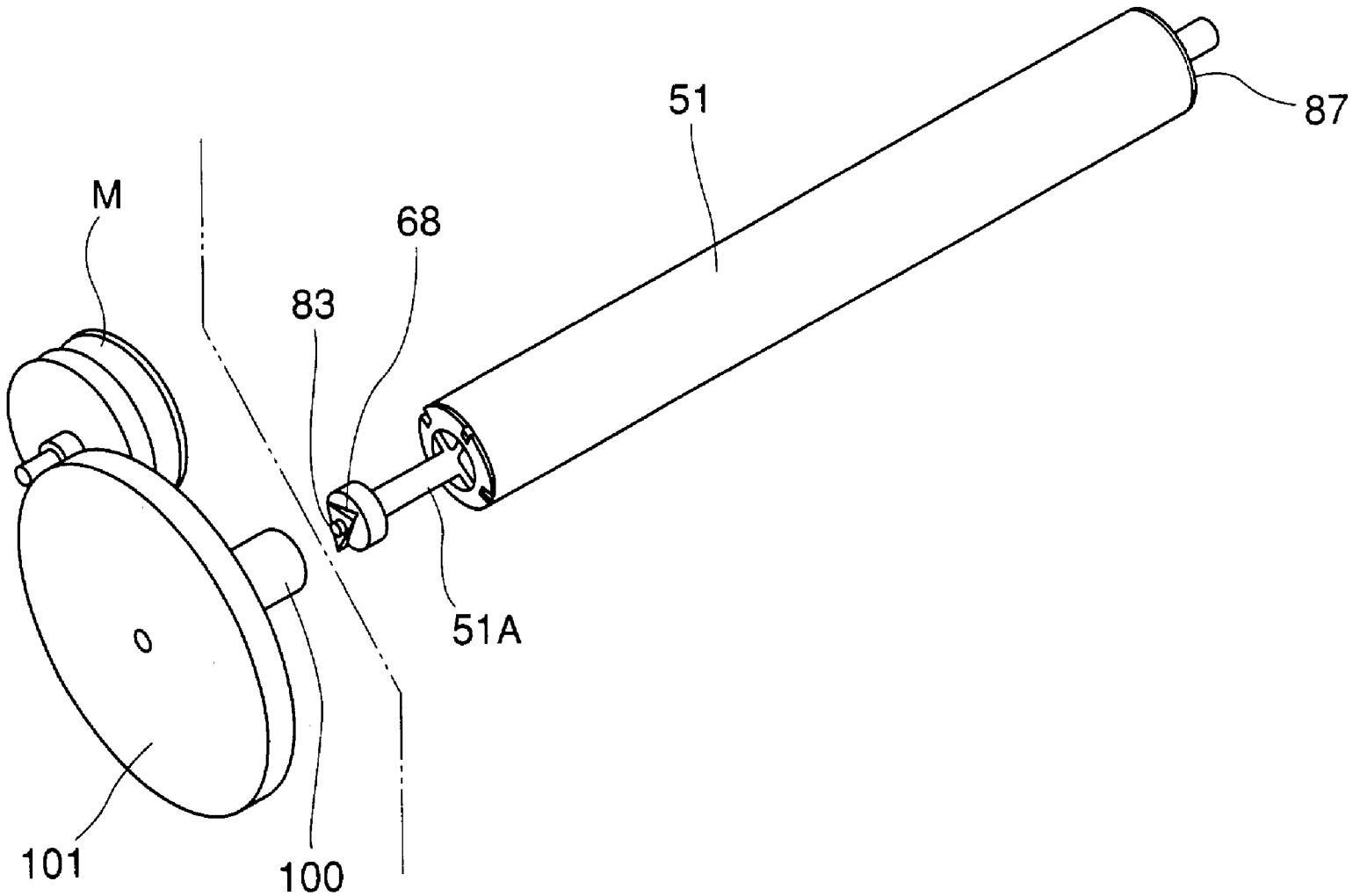
FIG. 13 is a schematic perspective view of one of the essential parts of the driving force transmitting mechanism for transmitting a driving force to the photoconductive drum in the embodiment of a process cartridge in accordance with the present invention.
Figure 14:
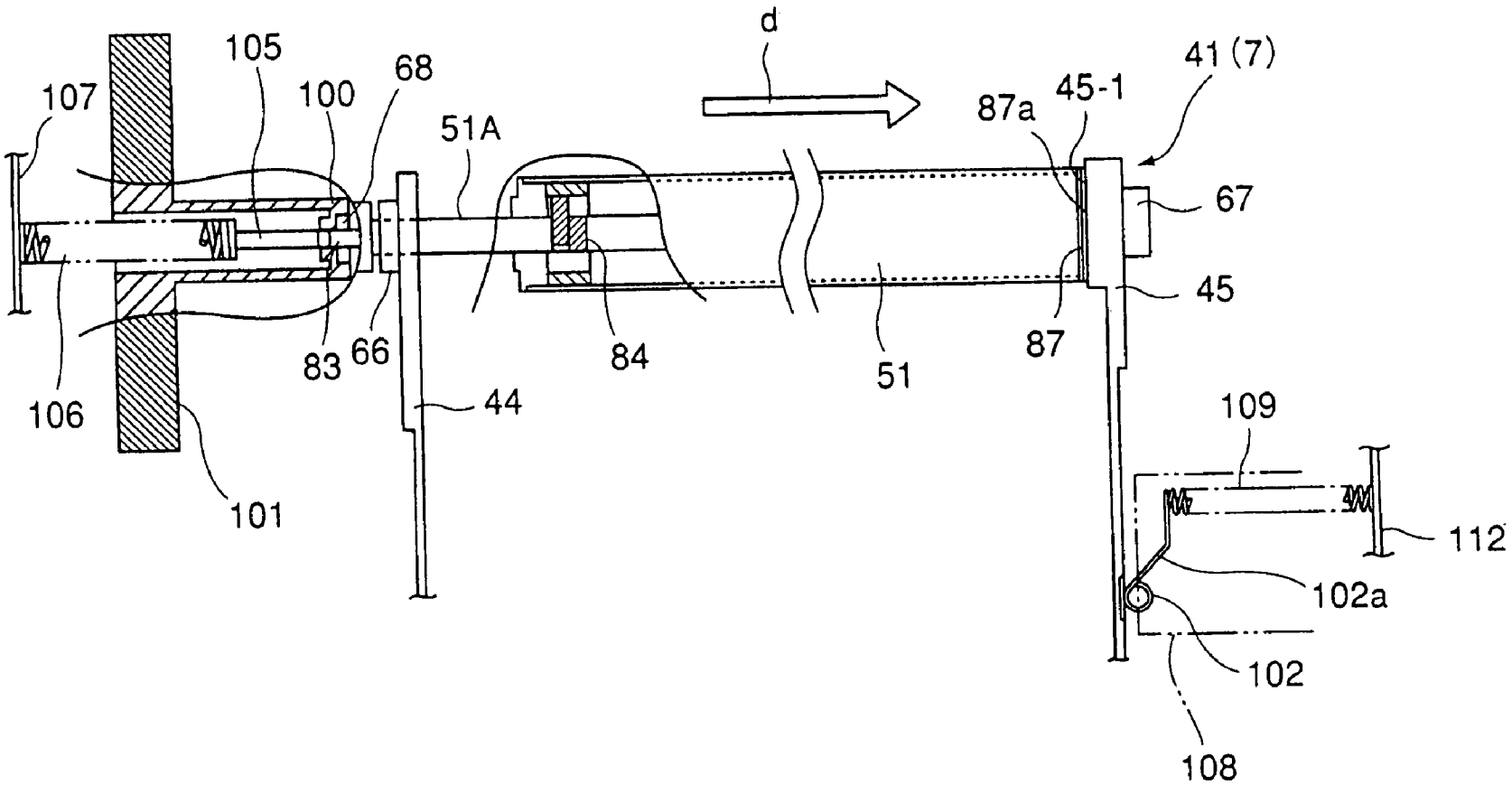
FIG. 14 is a partially broken view of the combination of the charge bias contact on the cartridge side and the charge bias contact on the main-assembly side, and the combination of the ground contact on the cartridge side and the ground contact on the main-assembly side, for showing the state of their connection.

Also in this embodiment, the process cartridge 7 has the cartridge coupling 68, which is attached to one end of the drum shaft 51A extending outward of the process cartridge 7 in the axial direction of the photoconductive drum 51, as described before. This cartridge coupling 68 is structured so that it couples with the axial end of the driving coupling 100 on the apparatus-main-assembly side. Referring to FIGS. 12–14, the driving coupling 100 on the apparatus-main-assembly side has a helical gear 101, which is on the axial end of the driving coupling 100. This helical gear 101 meshes with a motor M for driving the photoconductive drum 51. The force from the motor M for driving the photoconductive drum 51 is transmitted to the driving coupling 100 through the helical gear 101, and then is transmitted to the cartridge coupling 68 from the driving coupling 100, rotating the photoconductive drum 51. As the helical gear 101 is rotated, it generates thrust (in the direction indicated by arrow mark d, as shown in FIG. 14). As a result, the photoconductive drum 51, which is in the top unit 41, with the presence of some play in terms of the lengthwise direction of the top unit 41, is pressured in the direction opposite to the direction of the cartridge coupling 68. Consequently, the lengthwise end 87*a* of the flange 87 attached to the other axial end of the photoconductive drum 51, is placed in contact with the internal surface 45-1 of the second end cover (side wall) 45 of the top unit 41, that is, the end cover on the non-driven side; in other words, the position of the photoconductive drum 51 relative to the process cartridge 7 in terms of the axial direction of the photoconductive drum 51 becomes fixed. The charge bias contact 80 is exposed from the second end cover (side wall) 45, that is, the end cover on the non-driven side, of the top unit 41. The ground contact 83 is attached to one end of the drum shaft 51A, extending a short distance (approximately 2.5 mm) outward from the end of the cartridge coupling 68. The drum shaft 51A extends through the cylindrical photoconductive drum 51 in the axial direction of the photoconductive drum 51, and is supported by the side walls (first and second end covers 44 and 45) of the top unit 41, with the interposition of bearings 66 and 67, respectively. The cylindrical portion of the internal surface of the photoconductive drum 51 and the peripheral surface of the drum shaft 51A are electrically connected by the ground plate 84, which is in contact with both surfaces; the photoconductive drum 51 and drum shaft 51A are electrically in connection with each other.

The charge bias contact 80 is on the upstream side, with reference to the photoconductive drum 51, in terms of the direction Y in which the process cartridge 7 is inserted. Further, it is near the portion of the process cartridge 7, by which the process cartridge 7 is supported by the apparatus main assembly 25 (FIG. 11). The charge bias contact 80 is electrically in connection with the charge roller 52 through an electrically conductive member 90, which is in contact with the charge roller shaft 52A (FIG. 19(*a*)).

Next, the developer charge bias contact 81 and the development bias contact 82 will be described. The two contacts 81 and 82 are on the side wall 46 of the bottom unit 42, on the non-driven side, that is, the same side as the side on which the second end cover 45 of the top unit 41, on which the charge bias 80 is present, is present. Referring to FIG. 11, the developer charge bias contact 81 and the development bias contact 82 are directly below the charge bias contact 80. Referring to FIG. 19(*b*), the development bias contact 82 is electrically in contact with the development roller 54 through an electrically conductive member 92, which is in contact with one end of the development roller shaft 54A, is electrically in contact with the developer supply roller 61 through the electrically conductive member 92, which is in contact with the one end of the developer supply roller shaft 61A, and is electrically in contact with the development blade 62 through the development blade supporting member 62A, which supports the development blade 62. Referring to FIG. 11, the developer charge bias contact 81 is between the charge bias contact 80 and the development bias contact 82. Further, the developer charge bias contact 81 is electrically in contact with the developer charging roller 53 through the electrically conductive member 91, which is in contact with one end of the shaft 53A of the developer charge roller 53, as shown in FIG. 19(*b*).

Next, the connection between the electrical contacts on the process-cartridge side and the electrical contacts on the image-forming-apparatus-main-assembly side will be described.

Figure 15:
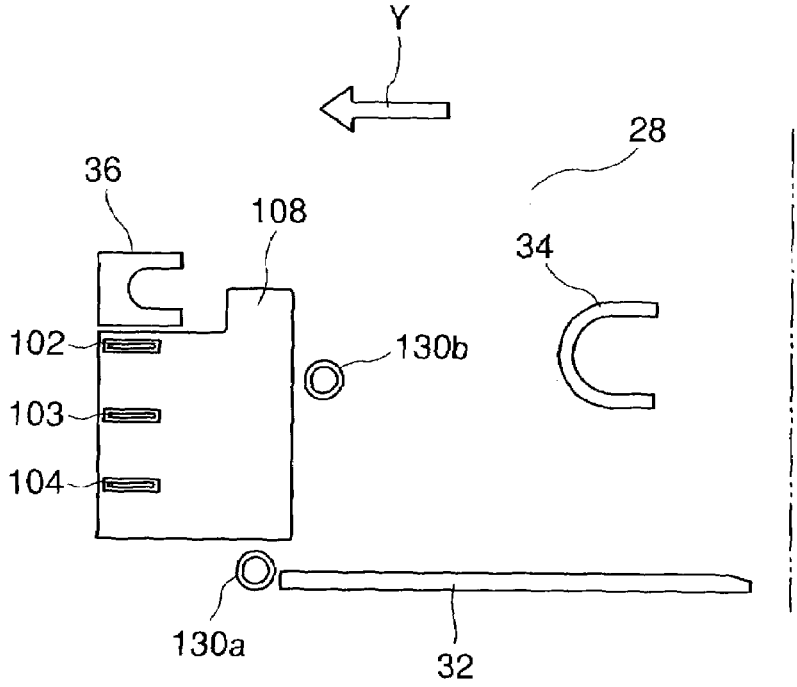
FIG. 15 is a plan view of the inward surface of the second side wall of the main assembly of the embodiment of an image forming apparatus in accordance with the present invention.
Figure 16:
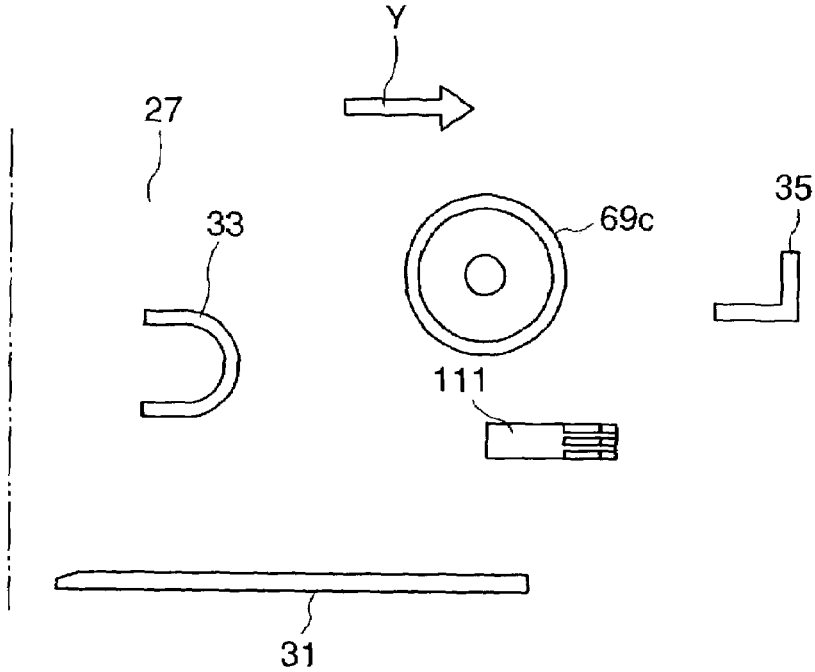
FIG. 16 is a plan view of the inward surface of the first side wall of the main assembly of the embodiment of an image forming apparatus in accordance with the present invention.

Referring to FIG. 15, the apparatus main assembly 25 has three electrical contacts 102, 103, and 104. More specifically, the electrical contacts 102, 103, and 104 are on the inward surface of the second side wall 28, that is, one of the side walls of the cartridge-mounting portion 30. They are held by a holder 108 so that they come into contact with the electrical contacts 80–82, correspondingly, as the process cartridge 7 is mounted into the cartridge-mounting portion 30. The electrical contact 102 is the charge bias contact (the first electrical contact on the main-assembly side, which hereinafter will be referred to as the first main assembly electrical contact) which contacts the charge bias contact 80 on the cartridge side, and the electrical contact 103 is the developer charge bias contact (second electrical contact on the main-assembly side, which hereinafter will be referred to as second main assembly electrical contact), which contacts the developer charge bias contact 81 on the cartridge side. The electrical contact 104 is the developer bias contact (the third electrical contact on the main assembly side, which hereinafter will be referred to as the third main assembly electrical contact), which contacts the development bias contact 82 on the cartridge side. Referring to FIGS. 13 and 16, the apparatus main assembly 25 also has a ground contact 105 (the fourth electrical contact on the main-assembly side, which hereinafter will be referred to as the fourth main assembly electrical contact), which is on the first side wall 27, that is, the side wall of the cartridge-mounting portion 30 of the apparatus main assembly 25, on the side opposite to the side where the electrical contacts 102, 103, and 104 are present. The fourth main assembly electrical contact 105 is the electrical contact which comes into contact with the ground contact 83 on the cartridge side, as the process cartridge 7 is mounted into the cartridge-mounting portion 30 of the apparatus main assembly 25. The ground contact 105 is within the driving coupling 100, which is an integral part of the helical gear 101, being on one of the end surfaces of the helical gear 101. Referring to FIG. 16, reference numeral 111 stands for a leaf spring, which is attached to the first side wall 27, and which keeps the cartridge 7 pressured toward the second side wall 28 on which the electrical contacts 102–104 are present.

Referring to FIG. 15, the charge bias contact 102 is on the inward surface of the second side wall 28, is below the third guide 36 on the main-assembly side, and is at a level higher than the level of the light receiving element 130*b* which constitutes the developer remainder detecting means. The developer charge bias contact 103 and development bias contact 104 are in alignment in the vertical direction, are below the charge bias contact 102, are below the light receiving element 130*b* which constitutes the developer remainder detecting means, and are at levels higher than the level of the light emitting element 130*a*.

At this time, the positional relationship among the electrical contacts and guides, on the apparatus-main-assembly side, will be described with reference to FIG. 15.

In terms of the vertical direction, the developer bias contact 104 and the developer charge bias contact 103, which are the electrical contacts on the power supply side, are at the level higher than the level of the light emitting element 130*a*, which is the bottommost portion of the aforementioned components on the process-cartridge side. Also in terms of the vertical direction, the light receiving element 130*b* is at the level higher than the levels of the electrical contacts 103 and 104 on the main-assembly side, and the charge bias contact 102 is at the level higher than the level of the light receiving element 130*b*. The third guide 36 on the main-assembly side is the topmost member. In terms of the cartridge-mounting direction Y, the third guide 36 on the main-assembly side, charge bias contact 102, the developer charge bias contact 103, and development bias contact 104 are the most upstream components, being at approximately the same points, and the light emitting element 130*a* is on the downstream side of the preceding four components. The light receiving element 130*b* is on the downstream side of the light emitting element 130*a*. With the electrical contacts and guides, on the apparatus-main-assembly side, disposed as described above, the electrical contacts 102–104 which are connected to the electrical component substrate on the apparatus-main-assembly side, and which supply the process cartridge 7 with power, and the two elements 130*a* and 130*b*, are all on, or in the adjacencies of, the second side wall 28 of the image-forming-apparatus main assembly 25, on the non-driven side, reducing the distances over which the electrodes are routed.

The sizes of the electrical contacts are as follows. Referring to FIG. 11, the charge bias contact 80, developer charge bias contact 81, and the development bias contact 82 are in the form of a rectangular parallelepiped. The charge bias contact 80 is approximately 5.5 mm in terms of the vertical direction of the drawing, and approximately 17 mm in terms of the horizontal direction of the drawing. The developer charge bias contact 81 and the development bias contact 82 are approximately 8.5 mm in terms of the vertical direction of the drawing, and are approximately 10 mm in terms of the horizontal direction. The ground contact 83 is circular, and its external diameter is approximately 8 mm.

Referring to FIG. 14, the ground contact 105 is on the driving coupling 100, being kept in contact with the inward surface of the driving coupling 100 by a compression spring 106, and is backed up by a backing member 107 so that the photoconductive drum 51 is grounded through the chassis of the apparatus main assembly 25. The other electrical contacts, that is, electrical contacts 102, 103, and 104, on the apparatus-main-assembly side, are elastic, and are held by the holder 108, protruding partially from the holder 108. Next, the manner in which the electrical contacts 102, 103, and 104 are held by the holder 108 will be described with reference to the charge bias contact 102. The charge bias contact 102 is held within the holder 108, being allowed to partially protrude from the holder 108. The holder 108 is attached to the inward surface of the second side wall 28 of the apparatus main assembly 25. To the outward surface of the second side wall 28 of the apparatus main assembly 25, the electrical wiring substrate 112 is attached, the patterned wiring of which is kept electrically in contact with the charge bias contact 102 by an electrically conductive compression spring 109.

Figure 17:
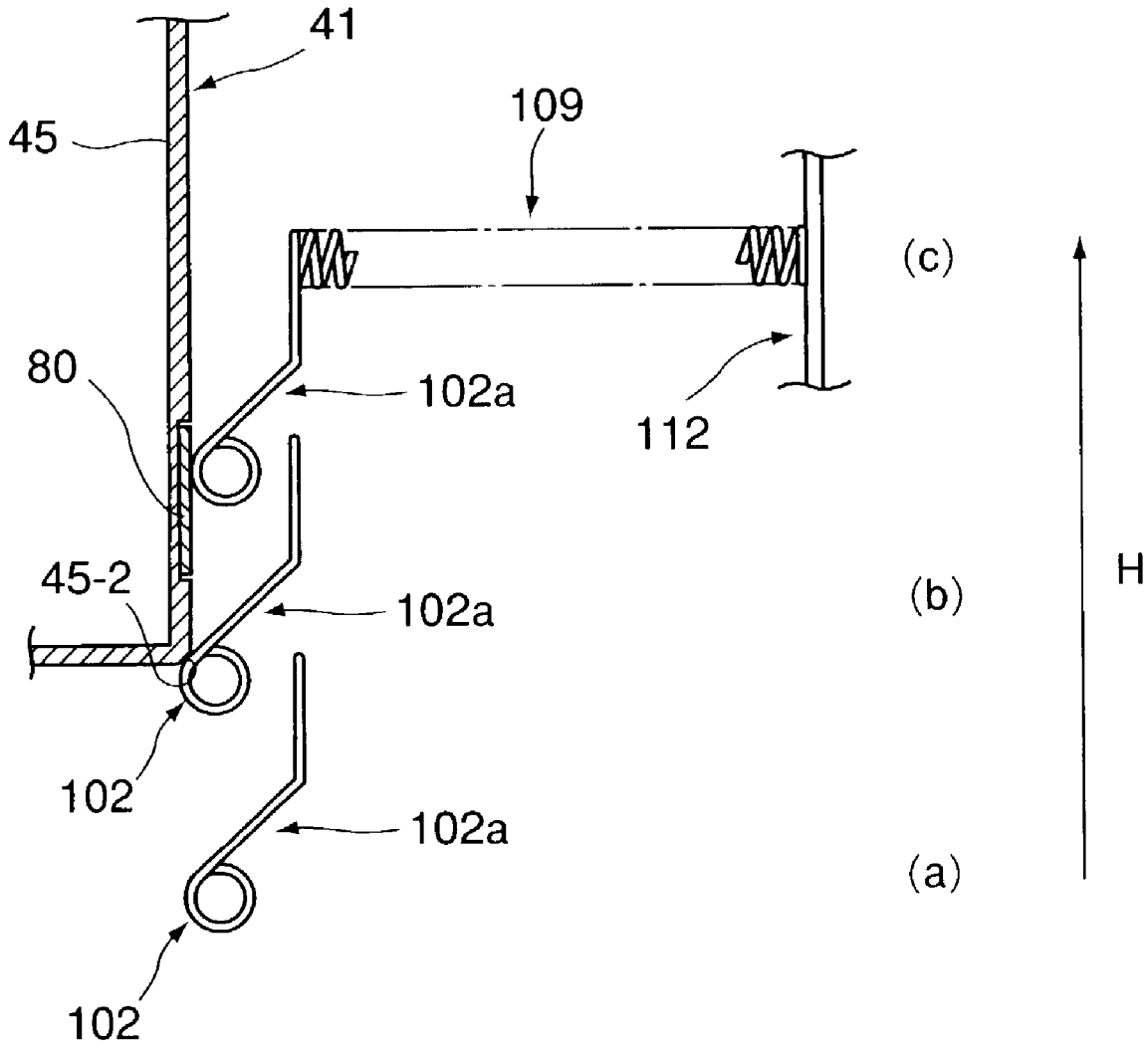
FIG. 17 is a schematic drawing for showing the different stages of the process through which the electrical contacts on the cartridge side are connected to the corresponding electrical contacts on the main-assembly side, in the embodiment of an image forming apparatus in accordance with the present invention, with reference to the combination of the bias contact on the cartridge side and the bias contact on the main assembly side.

Next, referring to FIG. 17, the manner in which the electrical contacts on the cartridge side come into contact with the electrical contacts on the apparatus main-assembly side as the cartridge 7 is mounted into the apparatus main assembly 25, will be described, with reference to the charge bias contact 80 on the cartridge side and the charge bias contact 102 on the main-assembly side. FIG. 17 is a schematic sectional view of the process cartridge 7, at the plane indicated by an arrow mark designated by a reference mark "o", for describing the state of the process cartridge 7 and its adjacencies, while the process cartridge 7 is mounted into the apparatus main assembly 25. The arrow mark indicated by a reference character H in FIG. 17 shows the direction in which the charge bias contact 102 on the apparatus main-assembly side moves relative to the process cartridge 7 when the process cartridge 7 is mounted into the apparatus main assembly 25.

Before the cartridge 7 reaches a predetermined point in the apparatus main assembly 25 while the cartridge 7 is inserted into the apparatus main assembly 25 along the guides 31, 32, and 35 on the apparatus-main-assembly side, the charge bias contact 102 is in the state shown in FIG. 17(*a*). In this state, the charge bias contact 102 has not come into contact with any point of the cartridge 7 (top unit 41). As the cartridge 7 (top unit 41) is further inserted into the apparatus main assembly 25, the charge bias contact 102 reaches the point shown in FIG. 17(*b*). In this state, the charge bias contact 102 is in contact with the corner 45-2 of the second end cover (side wall) 45 of the top unit 41. As the cartridge 7 is further inserted, the charge bias contact 102 advances further into the apparatus main assembly 25, while remaining in contact with the corner 45-2. As a result, the elastic portion 102*a* of the charge bias contact 102 gradually bends, allowing the charge bias contact 102 to smoothly reach the portion of the second end cover (side wall) 45, across which the charge bias contact 80 on the cartridge side is exposed. Then, as the cartridge 7 (top unit 41) is inserted to the predetermined point, the charge bias contact 102 reaches the point shown in Figure (c), at which it comes into contact with the charge bias contact 80 on the cartridge side. Similarly, the other two electrical contacts 103 and 104 on the apparatus-main-assembly side come into contact with the electrical contacts 81 and 82 on the cartridge side, respectively.

Figure 18:
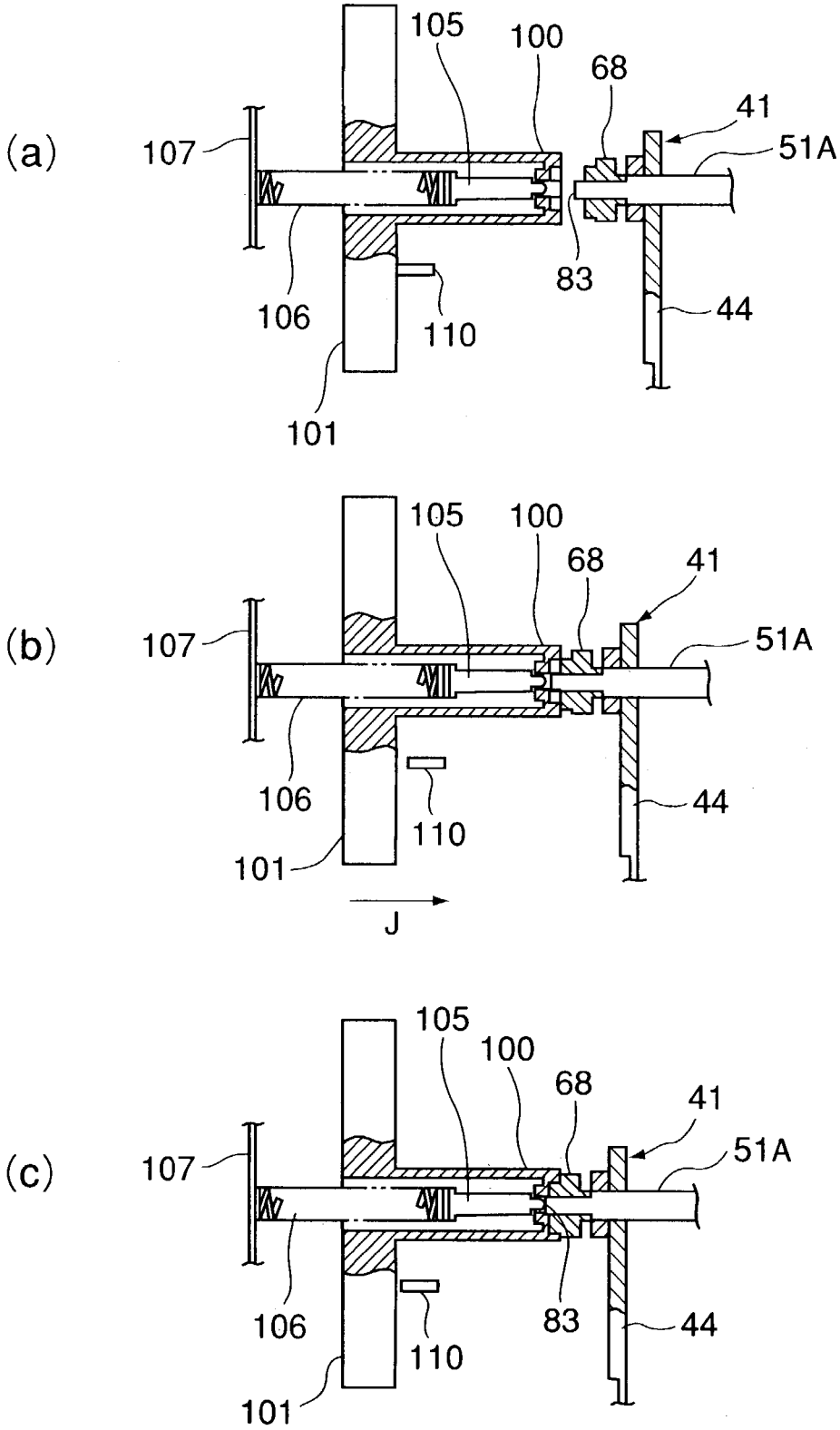
FIG. 18 is a sectional drawing of the combination of the ground contact on the cartridge side and the ground contact on the main-assembly side, in the embodiment of an image forming apparatus in accordance with the present invention, for sequentially describing the stages of the process through which the former is connected to the latter.

Next, referring to FIG. 18, the manner in which the ground contact 83 on the process-cartridge side comes into contact with the ground contact 105 on the image-forming-apparatus-main-assembly side, will be described.

Referring to FIG. 2, when the cartridge 7 is mounted into the apparatus main assembly 25, the front door 26 of the apparatus main assembly 25 is kept open. In this state, the ground contact 105, and the driving coupling 100 (inclusive of the helical gear 101 integral with the driving coupling 100) which internally holds the compression spring 106, are kept by a releasing member 110 at the first position (retraction position), at which the ground contact 105 cannot couple with the cartridge coupling 68, and the ground contact 105 is in the state shown in FIG. 18(*a*). In this state, the ground contact 105 has not come into contact with the ground contact 83 of the cartridge 7 (top unit 41). Then, the front door 26 is closed, with the cartridge 7 being at the predetermined point in the apparatus main assembly 25. As the front door 26 is closed, the image forming apparatus P becomes ready, as shown in FIG. 1, to carry out a printing operation. Also as the font door 26 is closed, the helical gear 101, which has been kept at the retraction portion by the releasing member 110, is allowed to move in the direction indicated by an arrow mark J, allowing thereby the driving coupling 100 to move to the second position, at which the driving coupling 100 can couple with the cartridge coupling 68, whereas the ground contact 105 enters into the state shown in FIG. 18(*b*). In this state, as the helical gear 101 is rotated by the aforementioned motor M, the coupling projection of the cartridge coupling 68 is gradually pulled deeper into the coupling hole of the driving coupling 100 because the coupling portion and coupling hole are in the form of a twisted pillar, the cross section of which is in the form of an equilateral triangle. By the time the helical gear 101 is rotated 120 degrees, the two couplings 100 and 68 fully couple, causing the ground contact 105 to reach the point shown in FIG. 18(*c*), at which the ground contact 105 on the apparatus-main-assembly side comes into contact with the ground contact 83 on the process cartridge side.

As described above, in this embodiment, as the process cartridge 7 is moved into the predetermined mounting position in the cartridge-mounting portion, along the guides 31, 32, and 36, the electrical contacts 80–82 on the process-cartridge side become reliably connected to the electrical contacts 102–104 on the main-assembly side, respectively. The ground contact 105 comes into contact with, being therefore electrically connected to, the ground contact 83 projecting from the cartridge coupling 68, as the helical gear 101 is rotated no more than a predetermined angle after the closing of the front door 26 of the apparatus main assembly 25, after the moving of the process cartridge 7 into the predetermined position. Consequently, the photoconductive drum 51 becomes grounded through the ground contact 83 on the cartridge side and the ground contact 105 on the main-assembly side.

Further, the charge bias contact 80 and charge bias contact 102 become electrically connected, allowing high voltage to be applied to the charge roller 52. The developer charge bias contact 81 becomes electrically connected to the developer charge bias contact 103, allowing high voltage to be applied to the developer charge roller 53. Further, the development bias contact 82 becomes electrically connected to the development bias contact 104, allowing high voltage to be applied to the development roller 54 and developer supply roller 61.

Next, what will happen as the photoconductive drum 51 is rotated by driving the image forming apparatus P will be described. For the purpose of making it easier to insert the process cartridge 7 into the apparatus main assembly 25 of the image forming apparatus P, the process cartridge 7 and the apparatus main assembly 25 are structured so that there will be a play of approximately 2–3 mm between the process cartridge 7 and apparatus main assembly 25, in terms of the axial direction of the photoconductive drum 51. Thus, the distance by which the charge bias contact 102 and the like protrudes must be no less than the play between the process cartridge 7 and apparatus main assembly 25 in terms of the axial direction, or thrust direction, of the photoconductive drum 51. In this embodiment, therefore, the leaf spring 111 is attached to the first side wall 27, as shown in FIG. 16, so that when the cartridge 7 is in the predetermined position in the apparatus main assembly 25, the cartridge 7 is kept pressured by the leaf spring 111 toward the second side wall 28 which holds the electrical contacts 102–104 on the apparatus-main-assembly side. The leaf spring 111 approximately opposes the area of the second side wall 28, on which the electrical contacts 102–104 are present, and is at the level higher than the level of the first guide 31 of the main assembly.

With the helix angle of the teeth of the helical gear 101 and gear 69 set, as in this embodiment, so that as the helical gear 101 is rotated, thrust is generated in the direction to push the process cartridge 7 toward the side where the electrical contacts 102–104 are present, and the position of the photoconductive drum 51 relative to the apparatus main assembly 25 is determined on the side where the electrical contacts 80–82 are present, making it possible to more accurately position the photoconductive drum 51 and electrical contacts 80–82 relative to the apparatus main assembly 25.

Further, with the coupling hole of the driving coupling 100 and the coupling projection of the cartridge coupling 68 being in the form a twisted pillar, the cross section of which is in the form of an equilateral triangle, as in this embodiment, as the helical gear 101 rotates, the driving coupling 100 integral with the helical gear 101 rotates, and an electrical connection is reliably established between the ground contact 83 and ground contact 105.

Further, with the electrical contacts 80–82 of the process cartridge 7 all being placed on one of the side walls of the cartridge frame, and the cartridge being kept pressured by a leaf spring, as in this embodiment, an electrical connection is reliably established and maintained between the electrical contacts 80–82 of the process cartridge 7 and the electrical contacts on the apparatus-main-assembly side, respectively.

Placing all the electrical contacts connected to the electrical wiring on the substrate to supply the wiring with power, and all of the various functional elements, at only one lengthwise end of the image-forming-apparatus main assembly, as in this embodiment, makes it possible to reduce the distance the electrodes are intricately extended. Therefore, it is possible to make an image forming apparatus more reliable in terms of electrical connection that is established.

Further, with the above-described setup, the electrical wiring substrate on the apparatus-main-assembly side connected to the electrical contacts on the main-assembly side can be vertically placed on one of the side walls of the apparatus main assembly to reduce the size of the apparatus.

Further, the driving members for driving the process cartridge 7 are placed at the lengthwise end opposite to the lengthwise end where the electrical wiring substrate is present, improving the image forming apparatus in terms of spatial efficiency, in addition to the above-described effects.

The above-described embodiment of the present invention may be summarized as follows.

According to the primary characteristic aspect of the embodiment of a process cartridge in accordance with the present invention, the process cartridge, which is removably mountable in the main assembly of an electrophotographic image forming apparatus, comprises: the first frame 41; the second frame 42 connected to the first frame 41, being enabled to pivot about the shaft 43; the electrophotographic photoconductive drum 51 disposed in the first frame 41; the photoconductive drum charging member 53 disposed in the first frame to charge the electrophotographic photoconductive drum; the developing member 54 disposed in the second frame 42 to develop an electrostatic latent image formed on the photoconductive drum 51 with the use of developer; the developer supplying member 61 disposed in the second frame 42 to supply developer to the peripheral surface of the developing member 54; the regulating member 62 disposed in the second frame 42 to regulate the amount of the developer adhering to the peripheral surface of the developing member 54; the first electrical contact 80 attached to the first frame 41 to receive from the image-forming-apparatus main assembly 25, the electrical bias to be supplied to the photoconductive drum charging member 52, when the process cartridge 7 is in the proper position in the image-forming-apparatus main assembly 25; the third electrical contact 82 attached to the second frame 42 to receive from the image-forming-apparatus main assembly 25, the electrical bias to be supplied to the developing member 54, the developer supplying member 61, and the regulating member 62 when the process cartridge 7 is in the proper position in the image-forming-apparatus main assembly 25; and the fourth electrical contact 83 attached to the first frame 41, with the center of the contact 83 coinciding with the axial line of the photoconductive drum 51, to ground the photoconductive drum 51, to the image-forming-apparatus main assembly 25 when the process cartridge 7 is in the proper position in the image-forming-apparatus main assembly 25, wherein the first and third electrical contacts 80 and 82 are on the same end of the process cartridge 7 in terms of the lengthwise direction of the process cartridge 7, with the electrical contacts 80 and 82 attached to the first and second frames 41 and 42, respectively, and the fourth electrical contact 83 is on the other end of the process cartridge 7, and wherein the electrical contacts of the process cartridge were positioned so that when the process cartridge 7 is in the proper position in the image-forming-apparatus main assembly 25, the first electrical contact 80 will be at a level higher than the level of the third electrical contact 82.

According to another characteristic aspect of the embodiment of a process cartridge in accordance with the present invention, the second frame 42 holds the developer charging member 53 for charging the developer adhering to the peripheral surface of the developing member 54, and the second electrical contact 81 for receiving from the image-forming-apparatus main assembly 25, the electrical bias to be supplied to the developer charging member 53 when the process cartridge 7 is in the proper position in the image-forming-apparatus main assembly 25, wherein the second electrical contact 81 is at one of the lengthwise ends of the bottom frame 42, and between the first and third electrical contacts 80 and 82.

According to another characteristic aspect of the embodiment of a process cartridge in accordance with the present invention, the fourth electrical contact 83 is in the center of the coupling member 68 for receiving from the image-forming-apparatus main assembly 25, the driving force for rotating the photoconductive drum 51 when the process cartridge 7 is in the proper position in the image-forming-apparatus main assembly 25, and that the fourth electrical contact 83 projects beyond the end surface of the coupling member 68.

According to another characteristic aspect of the embodiment of a process cartridge in accordance with the present invention, the second frame 42 has the developer storage portion 59 in which the developer to be used by the developing member 54 for the development of an electrostatic latent image is stored, and the developer storage portion 59 has: the top and bottom transparent windows 59*c* and 59*b* positioned so that they will be at the top and bottom of the developer storage portion 59 when the process cartridge 7 is in the proper position in the image-forming-apparatus main assembly 25; the bottom light guide 131*a* extending from the bottom transparent window 59*b* toward the other end of the developer storage portion, in the lengthwise direction of the developer storage portion 59, to guide the light beam L emitted from the light emitting member 130*a* of the image-forming-apparatus main assembly 25 to the bottom transparent window 59*b*, when the process cartridge 7 is in the proper position in the image-forming-apparatus main assembly 25; top light guide 132*a* extending from the top transparent window 59*c* toward the other end of the developer storage portion, in the lengthwise direction of the developer storage portion 59 to guide the light beam L to the light receiving member 130*b* of the image-forming-apparatus main assembly 25 after the light beam L passes through the top transparent window 59*c* and the internal space of the developer storage portion 59, when the process cartridge 7 is in the proper position in the image-forming-apparatus main assembly 25, wherein as the light receiving member 130*b* receives a predetermined amount of light, it is determined on the image-forming-apparatus-main-assembly side that the amount of the developer T in the developer storage portion 59 has been reduced below a predetermined amount; the lengthwise end of the bottom light guide 131*a*, which is not in contact with the bottom transparent window 59*b*, is on the slightly inward side of the corresponding lengthwise end of the second frame 42; the top light guide 132*a* is between the first and second frame 41 and 42, and is outside the primary scanning range of the laser beam projected onto the photoconductive drum 51 from the image-forming-apparatus main assembly 25 when the process cartridge 7 is in the proper position in the image-forming-apparatus main assembly 25.

According to another characteristic aspect of the embodiment of a process cartridge in accordance with the present invention, the electrical contacts 81, 82, and 83 on the process-cartridge side are on the downstream side with respect to the rotational (pivotal) axis 43 of the first and second frames 41 and 42 in terms of the cartridge-insertion direction.

According to the primary characteristic aspect of the embodiment of an electrophotographic image forming apparatus in accordance with the present invention, the electrophotographic image forming apparatus, in which a process cartridge is removably mountable, and which is for forming an image on recording medium, comprises: (a) a first electrical contact 102; (c) a third electrical contact 104; (d) a fourth electrical contact 105; and (e) a cartridge-mounting portion 30, in which a process cartridge comprising: the first frame 41; the second frame 42 connected to the first frame 41, being enabled to pivot about the shaft 43; electrophotographic photoconductive drum 51 disposed in the first frame 41; photoconductive drum charging member 53 disposed in the first frame to charge the electrophotographic photoconductive drum 51; developing member 54 disposed in the second frame 42 to develop an electrostatic latent image formed on the photoconductive drum 51 with the use of developer; developer supplying member 61 disposed in the second frame 42 to supply developer to the peripheral surface of the developing member 54; the regulating member 62 disposed in the second frame 42 to regulate the amount of the developer adhering to the peripheral surface of the developing member 54; the first electrical contact 80 attached to the first frame 41 to receive from the image-forming-apparatus main assembly 25, the electrical bias to be supplied to the photoconductive drum charging member 52, when the process cartridge 7 is in the proper position in the image-forming-apparatus main assembly 25; the third electrical contact 82 attached to the second frame 42 to receive from the image-forming-apparatus main assembly 25, the electrical bias to be supplied to the developing member 54, the developer supplying member 61, and the regulating member 62, when the process cartridge 7 is in the proper position in the image-forming-apparatus main assembly 25; and the fourth electrical contact 83, which is attached to the first frame 41, with the center of the contact 83 coinciding with the axial line of the photoconductive drum 51, to be electrically connected to the fourth electrical contact 105 on the main-assembly side to ground the photoconductive drum 7, to the image-forming-apparatus main assembly 25, when the process cartridge 7 is in the proper position in the image-forming-apparatus main assembly 25, wherein the first and third electrical contacts 80 and 82 are on the same end of the process cartridge 7 in terms of the lengthwise direction of the process cartridge 7, with the electrical contacts 80 and 82 attached to the first and second frames 41 and 42, respectively, and the fourth electrical contact 83 is on the other end of the process cartridge 7, and wherein the electrical contacts of the process cartridge were positioned so that when the process cartridge 7 is in the proper position in the image-forming-apparatus main assembly 25, the first electrical contact 80 will be at the higher level than the the third electrical contact 82.

According to another characteristic aspect of the embodiment of an electrophotographic image forming apparatus in accordance with the present invention, the image-forming-apparatus main assembly 25 also has (b) the second electrical contact 103, and the process cartridge 7 has the developer charging member 53 attached to the second frame 42 to charge the developer adhering to the peripheral surface of the developing member 54, and the second electrical contact 81 attached to the second frame 42 to be electrically connected to the second electrical contact 103 on the main-assembly side to receive from the image-forming-apparatus main assembly 25, the electrical bias to be supplied to the developer charging member 53, when the process cartridge 7 is in the proper position in the main assembly 25, wherein the second electrical contact 81 is at one of the lengthwise ends of the bottom frame 42, and between the first and third electrical contacts 80 and 82.

According to another characteristic aspect of the embodiment of an electrophotographic image forming apparatus in accordance with the present invention, the image-forming-apparatus main assembly 25 has the light emitting member 130*a* and light receiving member 130*b* attached to the one of the lengthwise ends (side walls) of the second frame 42 in such a manner that when the process cartridge 7 is in the proper position in the main assembly 25, the light receiving member 130*b* will be above the light emitting member 130*a*.

According to another characteristic aspect of the embodiment of an electrophotographic image forming apparatus in accordance with the present invention, as the process cartridge is mounted into the image-forming-apparatus main assembly, an electrical connection is more accurately and precisely established between the process cartridge and image-forming apparatus main assembly. Further, the electrical contacts for supplying the process cartridge with power are placed on the same lengthwise end of the process cartridge, improving the degree of precision with which the electrical contacts are attached.

As described above, according to the present invention, as the process cartridge is mounted into the image-forming-apparatus main assembly, the electrical connection between the process cartridge and the image-forming-apparatus main assembly can be more accurately and precisely established.

Further, the process cartridge driving means and the electrical wiring substrate of the image-forming-apparatus main assembly can be better disposed in the image-forming-apparatus main assembly in terms of spatial efficiency; in other words, it is possible to reduce the space the image-forming-apparatus main assembly occupies. Therefore, it is possible to provide such a combination of a process cartridge and an image forming apparatus that is superior in spatial efficiency.

While the invention has been described with reference to the structures disclosed herein, it is not confined to the details set forth, and this application is intended to cover such modifications or changes as may come within the purposes of the improvements or the scope of the following claims.

What is claimed is:

1. A process cartridge detachably mountable to a main assembly of an electrophotographic image forming apparatus, comprising:

a first frame;

a second frame, coupled with said first frame, wherein said first and second frames are configured and positioned to rotate about a shaft relative to each other, wherein said second frame comprises:

a developer accommodating portion configured and positioned to accommodate a developer to be used for developing the electrostatic latent image, and said developer accommodating portion is provided with an upper transparent window and a lower transparent window at upper and lower positions, respectively, when said process cartridge is mounted to the main assembly of the image forming apparatus;

a lower light guide portion configured and positioned to guide, to said lower transparent window, light emitted by a light emission member provided in the main assembly of the image forming apparatus when said process cartridge is mounted to the main assembly of the image forming apparatus, said lower light guide portion extending from said lower transparent window toward said one longitudinal end of said second frame; and an upper light guide portion configured and positioned to guide, to a light receiving element provided in the main assembly of the image forming apparatus, the light having passed through the inside of said developer accommodating portion and through said upper transparent window when said process cartridge is mounted to the main assembly of the image forming apparatus, said upper light guide portion extending from said upper transparent window toward said one end of said second frame, thus permitting the main assembly of the apparatus to detect a reduction of the amount of the developer accommodated in said developer accommodating portion beyond a predetermined amount by reception of a predetermined light quantity by the light receiving element;

an electrophotographic photosensitive drum provided in said first frame;

a photosensitive drum charging member, provided in said first frame, configured and positioned to electrically charge said electrophotographic photosensitive drum;

a developing member, provided in said second frame, configured and positioned to develop an electrostatic latent image formed on said photosensitive drum with a developer;

a developer feeding member, provided in said second frame, configured and positioned to supply a developer onto a peripheral surface of said developing member;

a regulating member, provided in said second frame, configured and positioned to regulate an amount of the developer deposited on the peripheral surface of said developing member;

an electrical contact, provided in said first frame, configured and positioned to receive, from the main assembly of the image forming apparatus, a bias voltage to be supplied to said photosensitive drum charging member when said process cartridge is mounted to the main assembly of the image forming apparatus;

an electrical contact, provided in said second frame, configured and positioned to receive, from the main assembly of the image forming apparatus, a bias voltage to be supplied to said developing member, said developer feeding member, and said regulating member when said process cartridge is mounted to the main assembly of the image forming apparatus; and a ground electrical contact, provided in said first frame coaxially with said photosensitive drum, configured and positioned to electrically ground said photosensitive drum to the main assembly of the image forming apparatus when said process cartridge is mounted to the main assembly of the image forming apparatus, wherein said first frame has one and the other longitudinal ends, and said second frame has one and the other longitudinal ends adjacent said one and the other longitudinal ends of said first frame, respectively, and wherein said electrical contact configured and positioned to receive a bias voltage to be supplied to said photosensitive drum charging member and said electrical contact configured and positioned to receive a bias voltage to be supplied to said developing member, said developer feeding member, and said regulating member are disposed adjacent to said one longitudinal ends of said first frame and said second frame, respectively, and said ground electrical contact is disposed adjacent to the other longitudinal end of said first frame, and wherein said electrical contacts are disposed such that when said process cartridge is mounted to the main assembly of said image forming apparatus, said electrical contact configured and positioned to receive a bias voltage to be supplied to said photosensitive drum charging member takes a higher position than said electrical contact configured and positioned to receive a bias voltage to be supplied to said developing member, said developer feeding member, and said regulating member.

2. A process cartridge according to claim 1, wherein said second frame is provided with a developer charging member configured and positioned to electrically charge the developer deposited on the peripheral surface of said developing member and an electrical contact configured and positioned to receive, from the main assembly of the image forming apparatus, a bias voltage to be supplied to said developer charging member when said process cartridge is mounted to the main assembly of the image forming apparatus, wherein said electrical contact configured and positioned to receive a bias voltage to be supplied to said developer charging member is disposed adjacent to said one longitudinal end of said second frame at a position between said electrical contact configured and positioned to receive a bias voltage to be supplied to said photosensitive drum charging member and said electrical contact configured and positioned to receive a bias voltage to be supplied to said developing member, said developer feeding member, and said regulating member.

3. A process cartridge according to claim 1 or 2, further comprising a coupling member configured and positioned to receive, from the main assembly of the image forming apparatus, a driving force for rotating said photosensitive drum when said process cartridge is mounted to the main assembly of the image forming apparatus, wherein said ground electrical contact projects from an end surface of said coupling member.

4. A process cartridge according to claim 2, wherein said electrical contact configured and positioned to receive a bias voltage to be supplied to said photosensitive drum charging member, said electrical contact configured and positioned to receive a bias voltage to be supplied to said developing member, said developer feeding member, and said regulating member, and said electrical contact configured and positioned to receive a bias voltage to be supplied to said developer charging member are disposed downstream of a center of relative rotation between said first frame and said second frame with respect to a direction in which said process cartridge is mounted to the main assembly.

5. A process cartridge according to claim 1, wherein an end surface at one longitudinal end of the lower light guide portion is disposed inside said one longitudinal end of said second frame.

6. An electrophotographic image forming apparatus for forming an image on a recording material to which a process cartridge is detachably mountable, said apparatus comprising:

(a) an electrical contact positioned in a main assembly of said apparatus and configured and positioned to supply a bias voltage to a photosensitive drum charging member;

(b) an electrical contact positioned in the main assembly of said apparatus and configured and positioned to supply a bias voltage to a developing member, a developer feeding member, and a regulating member;

(c) a ground electrical contact positioned in the main assembly of said apparatus; and (d) a cartridge mounting portion configured and positioned to detachably mount the process cartridge, the process cartridge including:

a first frame;

a second frame coupled with the first frame, wherein the first and second frames are configured and positioned to rotate about a shaft relative to each other, wherein the second frame comprises:

a developer accommodating portion configured and positioned to accommodate a developer to be used for developing the electrostatic latent image, and the developer accommodating portion is provided with an upper transparent window and a lower transparent window at upper and lower positions, respectively, when the process cartridge is mounted to a main assembly of said image forming apparatus;

a lower light guide portion configured and positioned to guide, to the lower transparent window, light emitted by a light emission member provided in the main assembly of said image forming apparatus when the process cartridge is mounted to the main assembly of said image forming apparatus, the lower light guide portion extending from the lower transparent window toward the one longitudinal end of the second frame; and an upper light guide portion configured and positioned to guide, to a light receiving element provided in the main assembly of said image forming apparatus, the light having passed through the inside of the developer accommodating portion and through the upper transparent window when the process cartridge is mounted to the main assembly of said image forming apparatus, the upper light guide portion extending from the upper transparent window toward the one end of the second frame, thus permitting the main assembly of said apparatus to detect a reduction of the amount of the developer accommodated in the developer accommodating portion beyond a predetermined amount by reception of a predetermined light quantity by the light receiving element;

an electrophotographic photosensitive drum provided in the first frame;

the photosensitive drum charging member, provided in the first frame, configured and positioned to electrically charge the electrophotographic photosensitive drum;

the developing member, provided in the second frame, configured and positioned to develop an electrostatic latent image formed on the photosensitive drum with a developer;

the developer feeding member, provided in the second frame, configured and positioned to supply a developer onto a peripheral surface of the developing member;

the regulating member, provided in the second frame, configured and positioned to regulate an amount of the developer deposited on the peripheral surface of the developing member;

an electrical contact, provided in the first frame, configured and positioned to contact said electrical contact positioned in the main assembly of said apparatus and configured and positioned to supply a bias voltage to the photosensitive drum charging member and to receive, from the main assembly of said image forming apparatus, a bias voltage to be supplied to the photosensitive drum charging member when the process cartridge is mounted to the main assembly of said image forming apparatus;

an electrical contact, provided in the second frame, configured and positioned to contact said electrical contact configured and positioned to supply a bias voltage to the developing member, the developer feeding member, and the regulating member and to receive, from the main assembly of said image forming apparatus, a bias voltage to be supplied to the developing member, the developer feeding member and the regulating member when the process cartridge is mounted to the main assembly of said image forming apparatus; and a ground electrical contact, provided in the first frame coaxially with the photosensitive drum, configured and positioned to contact said ground electrical contact positioned in the main assembly of said apparatus to electrically ground the photosensitive drum to the main assembly of said image forming apparatus when the process cartridge is mounted to the main assembly of said image forming apparatus, wherein the first frame has one and the other longitudinal ends, and the second frame has one and the other longitudinal ends adjacent the one and the other longitudinal ends of the first frame, respectively, and wherein the electrical contact configured and positioned to receive a bias voltage to be supplied to the photosensitive drum charging member and the electrical contact configured and positioned to receive a bias voltage to be supplied to the developing member, the developer feeding member and the regulating member are disposed adjacent to the one longitudinal ends of the first frame and the second frame, respectively, and the ground electrical contact positioned in the first frame is disposed adjacent to the other longitudinal end of the first frame, and wherein the electrical contacts are disposed such that when the process cartridge is mounted to the main assembly of said image forming apparatus, the electrical contact configured and positioned to receive a bias voltage to be supplied to the photosensitive drum charging member takes a higher position than the electrical contact configured and positioned to receive a bias voltage to be supplied to the developing member, the developer feeding member and the regulating member.

7. An apparatus according to claim 6, further comprising:

an electrical contact positioned in a main assembly of said apparatus and configured and positioned to supply a bias voltage to a developer charging member, wherein the second frame is provided with the developer charging member, which is configured and positioned to electrically charge the developer deposited on the peripheral surface of the developing member, and an electrical contact configured and positioned to contact said electrical contact positioned in a main assembly of said apparatus and configured and positioned to supply a bias voltage to the developer charging member, to receive, from the main assembly of said image forming apparatus, a bias voltage to be supplied to the developer charging member when the process cartridge is mounted to the main assembly of said image forming apparatus, wherein the electrical contact positioned and configured to receive, from the main assembly of said image forming apparatus, a bias voltage to be supplied to the developer charging member is disposed adjacent to the one longitudinal end of the second frame at a position between the electrical contact configured and positioned to receive a bias voltage to be supplied to the photosensitive drum charging member and the electrical contact configured and positioned to receive a bias voltage to be supplied to the developing member, the developer feeding member and the regulating member.

8. An apparatus according to claim 6 or 7, further comprising the light emission member and the light receiving element disposed adjacent the one longitudinal ends of the first frame and the second frame of the process cartridge when the process cartridge is mounted to the main assembly of said apparatus, wherein said light receiving element is disposed above said light emission.

9. A process cartridge detachably mountable to a main assembly of an electrophotographic image forming apparatus, comprising:

a first frame;

a second frame coupled with said first frame, wherein said first and second frames are configured and positioned to rotate about a shaft relative to each other;

an electrophotographic photosensitive drum provided in said first frame;

a photosensitive drum charging member, provided in said first frame, configured and positioned to electrically charge said electrophotographic photosensitive drum;

a developing member, provided in said second frame, configured and positioned to develop an electrostatic latent image formed on said photosensitive drum with a developer;

a developer feeding member, provided in said second frame, configured and positioned to supply a developer onto a peripheral surface of said developing member;

a regulating member, provided in said second frame, configured and positioned to regulate an amount of the developer deposited on the peripheral surface of said developing member;

an electrical contact, provided in said first frame, configured and positioned to receive, from the main assembly of the image forming apparatus, a bias voltage to be supplied to said photosensitive drum charging member when said process cartridge is mounted to the main assembly of the image forming apparatus;

an electrical contact, provided in said second frame, configured and positioned to receive, from the main assembly of the image forming apparatus, a bias voltage to be supplied to said developing member, said developer feeding member, and said regulating member when said process cartridge is mounted to the main assembly of the image forming apparatus; and a ground electrical contact, provided in said first frame coaxially with said photosensitive drum, configured and positioned to electrically ground the photosensitive drum to the main assembly of the image forming apparatus when said process cartridge is mounted to the main assembly of the image forming apparatus, wherein said first frame has one and the other longitudinal ends, and said second frame has one and the other longitudinal ends adjacent said one and the other longitudinal ends of said first frame, respectively, and wherein said electrical contact configured and positioned to receive, from the main assembly of the image forming apparatus, a bias voltage to be supplied to said photosensitive drum charging member and said electrical contact configured and positioned to receive, from the main assembly of the image forming apparatus, a bias voltage to be supplied to said developing member, said developer feeding member, and said regulating member are disposed adjacent to said one longitudinal ends of said first frame and said second frame, respectively, and said ground electrical contact is disposed adjacent to the other longitudinal end of said first frame, and wherein said electrical contacts are disposed such that when said process cartridge is mounted to the main assembly of the image forming apparatus, said electrical contact configured and positioned to receive, from the main assembly of the image forming apparatus, a bias voltage to be supplied to said photosensitive drum charging member takes a higher position than said electrical contact configured and positioned to receive, from the main assembly of the image forming apparatus, a bias voltage to be supplied to said developing member, said developer feeding member, and said regulating member, wherein said second frame is provided with a developer charging member configured and positioned to electrically charge the developer deposited on the peripheral surface of said developing member and an electrical contact configured and positioned to receive, from the main assembly of the image forming apparatus, a bias voltage to be supplied to said developer charging member when said process cartridge is mounted to the main assembly of the image forming apparatus, wherein said electrical contact configured and positioned to receive, from the main assembly of the image forming apparatus, a bias voltage to be supplied to said developer charging member is disposed adjacent to said one longitudinal end of said second frame at a position between said electrical contact configured and positioned to receive, from the main assembly of the image forming apparatus, a bias voltage to be supplied to said photosensitive drum charging member and said electrical contact configured and positioned to receive, from the main assembly of the image forming apparatus, a bias voltage to be supplied to said developing member, said developer feeding member, and said regulating member, wherein said second frame has a developer accommodating portion configured and positioned to accommodate a developer to be used for developing the electrostatic latent image, and said developer accommodating portion is provided with an upper transparent window and a lower transparent window at upper and lower positions, respectively, when said process cartridge is mounted to the main assembly of said image forming apparatus, said second frame further comprising a lower light guide portion configured and positioned to guide, to said lower transparent window, light emitted by a light emission member provided in the main assembly of the image forming apparatus when said process cartridge is mounted to the main assembly of the image forming apparatus, said lower light guide portion extending from said lower transparent window toward said one longitudinal end of said second frame, said second frame further comprising an upper light guide portion configured and positioned to guide, to a light receiving element provided in the main assembly of the image forming apparatus, the light having passed through the inside of said developer accommodating portion and through said upper transparent window when said process cartridge is mounted to the main assembly of the image forming apparatus, said upper light guide portion extending from said upper transparent window toward said one end of said second frame, thus permitting the main assembly of the apparatus to detect a reduction of an amount of the developer accommodated in said developer accommodating portion beyond a predetermined amount by reception of a predetermined light quantity by the light receiving element.

10. A process cartridge according to claim 9, further comprising a coupling member configured and positioned to receive, from the main assembly of the image forming apparatus, a driving force for rotating said photosensitive drum when said process cartridge is mounted to the main assembly of the image forming apparatus, wherein said ground electrical contact projects from an end surface of said coupling member.

11. A process cartridge according to claim 9, wherein an end surface at one longitudinal end of the lower light guide portion is disposed inside said one longitudinal end of said second frame.

12. A process cartridge according to claim 9 or 11, wherein said upper light guide portion is disposed between said first frame and said second frame at one longitudinal end of an optical path through which a laser beam to be directed to said photosensitive drum from the main assembly of the image forming apparatus when said process cartridge is mounted to the main assembly of the image forming apparatus, is passed.

13. A process cartridge according to claim 9, 10 or 11, wherein said electrical contact configured and positioned to receive, from the main assembly of the image forming apparatus, a bias voltage to be supplied to said photosensitive drum charging member, said electrical contact configured and positioned to receive, from the main assembly of the image forming apparatus, a bias voltage to be supplied to said developing member, said developer feeding member, and said regulating member, and said electrical contact configured and positioned to receive, from the main assembly of the image forming apparatus, a bias voltage to be supplied to said developer charging member are disposed downstream of a center of relative rotation between said first frame and said second frame with respect to a direction in which said process cartridge is mounted to the main assembly.

14. A process cartridge detachably mountable to a main assembly of an electrophotographic image forming apparatus, comprising:

a first frame;

a second frame coupled with said first frame, wherein said first and second frames are configured and positioned to rotate about a shaft relative to each other;

an electrophotographic photosensitive drum provided in said first frame;

a photosensitive drum charging member, provided in said first frame, configured and positioned to electrically charge said electrophotographic photosensitive drum;

a developing member, provided in said second frame, configured and positioned to develop an electrostatic latent image formed on said photosensitive drum with a developer;

a developer feeding member, provided in said second frame, configured and positioned to supply a developer onto a peripheral surface of said developing member;

a regulating member, provided in said second frame, configured and positioned to regulate an amount of the developer deposited on the peripheral surface of said developing member;

an electrical contact, provided in said first frame, configured and positioned to receive, from the main assembly of the image forming apparatus, a bias voltage to be supplied to said photosensitive drum charging member when said process cartridge is mounted to the main assembly of the image forming apparatus;

an electrical contact, provided in said second frame, configured and positioned to receive, from the main assembly of the image forming apparatus, a bias voltage to be supplied to said developing member, said developer feeding member, and said regulating member when said process cartridge is mounted to the main assembly of the image forming apparatus; and a ground electrical contact provided in said first frame coaxially with said photosensitive drum configured and positioned to electrically ground said photosensitive drum to the main assembly of the image forming apparatus when said process cartridge is mounted to the main assembly of the image forming apparatus, wherein said first frame has one and the other longitudinal ends, and said second frame has one and the other longitudinal ends adjacent said one and the other longitudinal ends of said first frame, respectively, and wherein said electrical contact configured and positioned to receive, from the main assembly of the image forming apparatus, a bias voltage to be supplied to said photosensitive drum charging member and said electrical contact configured and positioned to receive, from the main assembly of the image forming apparatus, a bias voltage to be supplied to said developing member, said developer feeding member, and said regulating member are disposed adjacent to said one longitudinal ends of said first frame and said second frame, respectively, and said ground electrical contact is disposed adjacent to the other longitudinal end of said first frame, and wherein said electrical contacts are disposed such that when said process cartridge is mounted to the main assembly of the image forming apparatus, said electrical contact configured and positioned to receive, from the main assembly of the image forming apparatus, a bias voltage to be supplied to said photosensitive drum charging member takes a higher position than said electrical contact configured and positioned to receiver, from the main assembly of the image forming apparatus, a bias voltage to be supplied to said developing member, said developer feeding member, and said regulating member, wherein said second frame is provided with a developer charging member configured and positioned to electrically charge the developer deposited on the peripheral surface of said developing member and an electrical contact configured and positioned to receive, from the main assembly of the image forming apparatus, a bias voltage to be supplied to said developer charging member when said process cartridge is mounted to the main assembly of the image forming apparatus, wherein said electrical contact configured and positioned to receive, from the main assembly of the image forming apparatus, a bias voltage to be supplied to said developer charging member is disposed adjacent to said one longitudinal end of said second frame at a position between said electrical contact configured and positioned to receive, from the main assembly of the image forming apparatus, a bias voltage to be supplied to said photosensitive drum charging member and said electrical contact configured and positioned to receive, from the main assembly of the image forming apparatus, a bias voltage to be supplied to said developing member, said developer feeding member, and said regulating member, wherein said second frame has a developer accommodating portion configured and positioned to accommodate a developer to be used for developing the electrostatic latent image, and said developer accommodating portion is provided with an upper transparent window and a lower transparent window at upper and lower positions, respectively, when said process cartridge is mounted to the main assembly of said image forming apparatus, said second frame further comprising a lower light guide portion configured and positioned to guide, to said lower transparent window, light emitted by a light emission member provided in the main assembly of the image forming apparatus when said process cartridge is mounted to the main assembly of the image forming apparatus, said lower light guide portion extending from said lower transparent window toward said one longitudinal end of said second frame, said second frame further comprising an upper light guide portion configured and positioned to guide, to a light receiving element provided in the main assembly of the image forming apparatus, the light having passed through the inside of said developer accommodating portion and through said upper transparent window when said process cartridge is mounted to the main assembly of the image forming apparatus, said upper light guide portion extending from said upper transparent window toward said one end of said second frame, thus permitting the main assembly of the apparatus to detect a reduction of an amount of the developer accommodated in said developer accommodating portion beyond a predetermined amount by reception of a predetermined light quantity by the light receiving element, said process cartridge further comprising a coupling member configured and positioned to receive, from the main assembly of the image forming apparatus, a driving force for rotating said photosensitive drum when said process cartridge is mounted to the main assembly of the image forming apparatus, wherein said ground electrical contact projects from an end surface of said coupling member, wherein an end surface at one longitudinal end of said lower light guide portion is disposed inside said one longitudinal end of said second frame.

15. A process cartridge according to claim 14, wherein said upper light guide portion is disposed between said first frame and said second frame at one longitudinal end of an optical path through which a laser beam to be directed to said photosensitive drum from the main assembly of the image forming apparatus when said process cartridge is mounted to the main assembly of the image forming apparatus, is passed.

16. A process cartridge according to claim 14 or 15, wherein said electrical contact configured and positioned to receive, from the main assembly of the image forming apparatus, a bias voltage to be supplied to said photosensitive drum charging member, said electrical contact configured and positioned to receive, from the main assembly of the image forming apparatus, a bias voltage to be supplied to said developing member, said developer feeding member, and said regulating member and said electrical contact configured and positioned to receive, from the main assembly of the image forming apparatus, a bias voltage to be supplied to said developer charging member are disposed downstream of a center of relative rotation between said first frame and said second frame with respect to a direction in which said process cartridge is mounted to the main assembly.

17. A process cartridge according to claim 1, 5, 9, or 14, wherein said upper light guide portion is disposed between said first frame and said second frame at one longitudinal end of an optical path through which a laser beam to be directed to said photosensitive drum from the main assembly of the image forming apparatus when said process cartridge is mounted to the main assembly of the image forming apparatus, is passed.

18. An electrophotographic image forming apparatus for forming an image on a recording material to which a process cartridge is detachably mountable, said apparatus comprising:

(a) an electrical contact positioned in a main assembly of said apparatus and configured and positioned to supply a bias voltage to a photosensitive drum charging member;

(b) an electrical contact positioned in the main assembly of said apparatus and configured and positioned to supply a bias voltage to a developing member, a developer feeding member, and a regulating member;

(c) a ground electrical contact positioned in the main assembly of said apparatus;

(d) a cartridge mounting portion configured and positioned to detachably mount the process cartridge, the process including:

a first frame;

a second frame coupled with the first frame, wherein the first and second frames are positioned and configured to rotate about a shaft relative to each other;

an electrophotographic photosensitive drum provided in the first frame;

the photosensitive drum charging member, provided in the first frame, configured and positioned to electrically charge the electrophotographic photosensitive drum;

the developing member, provided in the second frame, configured and positioned to develop an electrostatic latent image formed on the photosensitive drum with a developer;

the developer feeding member, provided in the second frame, configured and positioned to supply a developer onto a peripheral surface of the developing member;

the regulating member, provided in the second frame, configured and positioned to regulate an amount of the developer deposited on the peripheral surface of the developing member;

an electrical contact, provided in the first frame, configured and positioned to contact said electrical contact positioned in the main assembly of said apparatus and configured and positioned to supply a bias voltage to the photosensitive drum charging member and to receive, from the main assembly of said image forming apparatus, a bias voltage to be supplied to the photosensitive drum charging member when the process cartridge is mounted to the main assembly of said image forming apparatus;

an electrical contact provided in the second frame, configured and positioned to contact said electrical contact positioned in the main assembly of said apparatus and configured and positioned to supply a bias voltage to the developing member, the developer feeding member, and the regulating member and to receive, from the main assembly of said image forming apparatus, a bias voltage to be supplied to the developing member, the developer feeding member, and the regulating member when the process cartridge is mounted to the main assembly of said image forming apparatus;

a ground electrical contact, provided in the first frame coaxially with the photosensitive drum, configured and positioned to contact said ground electrical contact positioned in the main assembly of said apparatus to electrically ground the photosensitive drum to the main assembly of said image forming apparatus when the process cartridge is mounted to the main assembly of said image forming apparatus, wherein the first frame has one and the other longitudinal ends, and the second frame has one and the other longitudinal ends adjacent said one and the other longitudinal ends of the first frame, respectively, and wherein the electrical contact configured and positioned to receive, from the main assembly of said image forming apparatus, a bias voltage to be supplied to the photosensitive drum charging member and the electrical contact configured and positioned to receive, from the main assembly of said image forming apparatus, a bias voltage to be supplied to the developing member, the developer feeding member, and the regulating member are disposed adjacent to said one longitudinal ends of the first frame and the second frame, respectively, and the ground electrical contact provided in the first frame is disposed adjacent to the other longitudinal end of the first frame, and wherein the electrical contacts are disposed such that when the process cartridge is mounted to the main assembly of said image forming apparatus, the electrical contact configured and positioned to receive, from the main assembly of said image forming apparatus, a bias voltage to be supplied to the photosensitive drum charging member takes a higher position than the electrical contact configured and positioned to receive, from the main assembly of said image forming apparatus, a bias voltage to be supplied to the developing member, the developer feeding member, and the regulating member; and (e) an electrical contact positioned in the main assembly of said apparatus and configured and positioned to supply a bias voltage to a developer charging member, wherein the second frame is provided with the developer charging member configured and positioned to electrically charge the developer deposited on the peripheral surface of the developing member and an electrical contact configured and positioned to contact said electrical contact positioned in the main assembly of said apparatus and configured and positioned to supply a bias voltage to a developer charging member and to receive, from the main assembly of said image forming apparatus, a bias voltage to be supplied to the developer charging member when the process cartridge is mounted to the main assembly of said image forming apparatus, wherein the electrical contact configured and positioned to receive, from the main assembly of said image forming apparatus, a bias voltage to be supplied to the developer charging member is disposed adjacent to said one longitudinal end of the second frame at a position between the electrical contact configured and positioned to receive, from the main assembly of said image forming apparatus, a bias voltage to be supplied to the photosensitive drum charging member and the electrical contact configured and positioned to receive, from the main assembly of said image forming apparatus, a bias voltage to be supplied to the developing member, the developer feeding member, and the regulating member, wherein the second frame has a developer accommodating portion configured and positioned to accommodate a developer to be used for developing the electrostatic latent image, and the developer accommodating portion is provided with an upper transparent window and a lower transparent window at upper and lower positions, respectively, when the process cartridge is mounted to the main assembly of said image forming apparatus, the second frame further comprising a lower light guide portion configured and positioned to guide, to the lower transparent window, light emitted by a light emission member provided in the main assembly of said image forming apparatus when the process cartridge is mounted to the main assembly of said image forming apparatus, the lower light guide portion extending from the lower transparent window toward said one longitudinal end of the second frame, the second frame further comprising an upper light guide portion configured and positioned to guide, to a light receiving element provided in the main assembly of said image forming apparatus, the light having passed through the inside of the developer accommodating portion and through the upper transparent window when the process cartridge is mounted to the main assembly of said image forming apparatus, the upper light guide portion extending from the upper transparent window toward said one end of the second frame, thus permitting the main assembly of said apparatus to detect a reduction of an amount of the developer accommodated in the developer accommodating portion beyond a predetermined amount by reception of a predetermined light quantity by said light receiving element.

19. An electrophotographic image forming apparatus for forming an image on a recording material to which a process cartridge is detachably mountable, said apparatus comprising:

(a) an electrical contact positioned in a main assembly of said apparatus and configured and positioned to supply a bias voltage to a photosensitive drum charging member;

(b) an electrical contact positioned in the main assembly of said apparatus and configured and positioned to supply a bias voltage to a developing member, a developer feeding member, and a regulating member;

(c) a ground electrical contact positioned in the main assembly of said apparatus;

(d) a cartridge mounting portion configured and positioned to detachably mount the process cartridge, the process cartridge including:

a first frame;

a second frame coupled with the first frame, wherein the first and second frames are configured and positioned to rotate about a shaft relative to each other;

an electrophotographic photosensitive drum provided in the first frame;

the photosensitive drum charging member, provided in the first frame, configured and positioned to electrically charge the electrophotographic photosensitive drum;

the developing member, provided in the second frame, configured and positioned to develop an electrostatic latent image formed on the photosensitive drum with a developer;

the developer feeding member, provided in the second frame, configured and positioned to supply a developer onto a peripheral surface of said developing member;

the regulating member, provided in the second frame, configured and positioned to regulate an amount of the developer deposited on the peripheral surface of the developing member;

an electrical contact, provided in the first frame, configured and positioned to contact said electrical contact positioned in a main assembly of said apparatus and configured and positioned to supply a bias voltage to the photosensitive drum charging member and to receive, from the main assembly of said image forming apparatus, a bias voltage to be supplied to the photosensitive drum charging member when the process cartridge is mounted to the main assembly of said image forming apparatus;

an electrical contact, provided in the second frame, configured and positioned to contact said electrical contact positioned in the main assembly of said apparatus and configured and positioned to supply a bias voltage to the developing member, the developer feeding member, and the regulating member and to receive, from the main assembly of said image forming apparatus, a bias voltage to be supplied to the developing member, the developer feeding member and the regulating member when the process cartridge is mounted to the main assembly of said image forming apparatus;

a ground electrical contact, provided in the first frame coaxially with the photosensitive drum, configured and positioned to contact said ground electrical contact positioned in said main assembly of said apparatus to electrically ground the photosensitive drum to the main assembly of said image forming apparatus when the process cartridge is mounted to the main assembly of said image forming apparatus, wherein the first frame has one and the other longitudinal ends, and the second frame has one and the other longitudinal ends adjacent the one and the other longitudinal ends of the first frame, respectively, and wherein the electrical contact configured and positioned to receive, from the main assembly of said image forming apparatus, a bias voltage to be supplied to the photosensitive drum charging member and the electrical contact configured and positioned to receive, from the main assembly of said image forming apparatus, a bias voltage to be supplied to the developing member, the developer feeding member and the regulating member are disposed adjacent to the one longitudinal ends of the first frame and the second frame, respectively, and the ground electrical contact provided in the first frame is disposed adjacent to the other longitudinal end of the first frame, and wherein the electrical contacts are disposed such that when the process cartridge is mounted to the main assembly of said image forming apparatus, the electrical contact configured and positioned to receive, from the main assembly of said image forming apparatus, a bias voltage to be supplied to the photosensitive drum charging member takes a higher position than the electrical contact configured and positioned to receive, from the main assembly of said image forming apparatus, a bias voltage to be supplied to the developing member, the developer feeding member and the regulating member, and (e) an electrical contact positioned in the main assembly of said apparatus and positioned and configured to supply a bias voltage to a developer charging member, wherein the second frame is provided with the developer charging member configured and positioned to electrically charge the developer deposited on the peripheral surface of the developing member, and an electrical contact configured and positioned to contact said electrical contact positioned in the main assembly of said apparatus and positioned and configured to supply a bias voltage to a developer charging member and to receive, from the main assembly of said image forming apparatus, a bias voltage to be supplied to the developer charging member when the process cartridge is mounted to the main assembly of said image forming apparatus, wherein the electrical contact configured and positioned to receive, from the main assembly of said image forming apparatus, a bias voltage to be supplied to the developer charging member is disposed adjacent to said one longitudinal end of the second frame at a position between the electrical contact configured and positioned to receive, from the main assembly of said image forming apparatus, a bias voltage to be supplied to the photosensitive drum charging member and said electrical contact configured and positioned to receive, from the main assembly of said image forming apparatus, a bias voltage to be supplied to the developing member, the developer feeding member and the regulating member, said process cartridge further including a coupling member configured and positioned to receive, from the main assembly of said image forming apparatus, a driving force for rotating the photosensitive drum when the process cartridge is mounted to the main assembly of said image forming apparatus, wherein the ground electrical contact provided in said first frame projects from an end surface of the coupling member, wherein the second frame has a developer accommodating portion configured and positioned to accommodate a developer to be used for developing the electrostatic latent image, and the developer accommodating portion is provided with an upper transparent window and a lower transparent window at upper and lower positions, respectively, when the process cartridge is mounted to the main assembly of said image forming apparatus, the second frame further comprising a lower light guide portion configured and positioned to guide, to the lower transparent window, light emitted by a light emission member provided in the main assembly of said image forming apparatus when the process cartridge is mounted to the main assembly of said image forming apparatus, said lower light guide portion extending from the lower transparent window toward said one longitudinal end of the second frame, the second frame further comprising an upper light guide portion configured and positioned to guide, to a light receiving element provided in the main assembly of said image forming apparatus, the light having passed through the inside of the developer accommodating portion and through the upper transparent window when the process cartridge is mounted to the main assembly of said image forming apparatus, the upper light guide portion extending from the upper transparent window toward said one end of the second frame, thus permitting the main assembly of said apparatus to detect a reduction of an amount of the developer accommodated in the developer accommodating portion beyond a predetermined amount by reception of a predetermined light quantity by said light receiving element, wherein an end surface at one longitudinal end of the lower light guide portion is disposed inside said one longitudinal end of the second frame.

20. An electrophotographic image forming apparatus according to claim 6, 17, or 18, wherein the upper light guide portion is disposed between the first frame and the second frame at one longitudinal end of an optical path through which a laser beam to be directed to the photosensitive drum from the main assembly of said image forming apparatus when the process cartridge is mounted to the main assembly of said image forming apparatus, is passed.

UNITED STATES PATENT AND TRADEMARK OFFICE

CERTIFICATE OF CORRECTION

PATENT NO. : 7,085,516 B2
APPLICATION NO. : 10/351849
DATED : August 1, 2006
INVENTOR(S) : Tachio Kawai et al.

It is certified that error appears in the above-identified patent and that said Letters Patent is hereby corrected as shown below:

TITLE PAGE AT ITEM [57]:
Abstract, Line 16, “that,” should read --that--.

COLUMN 1:
Line 30, “plurality” should read --a plurality--.

COLUMN 12:
Line 20, “unit” should read --units,--.

COLUMN 29:
Line 27, “member,” should read --member--.
Line 47, “ends” should read --end--.
Line 58, “member,” should read --member--.

COLUMN 32:
Line 17, “ends” should read --end--.
Line 60, “ends” should read --end--.
Line 64, “emission.” should read --emission member.--.

COLUMN 33:
Line 53, “ends” should read --end--.

COLUMN 36:
Line 17, “ends” should read --end--.

UNITED STATES PATENT AND TRADEMARK OFFICE

CERTIFICATE OF CORRECTION

PATENT NO. : 7,085,516 B2
APPLICATION NO. : 10/351849
DATED : August 1, 2006
INVENTOR(S) : Tachio Kawai et al.

It is certified that error appears in the above-identified patent and that said Letters Patent is hereby corrected as shown below:

COLUMN 39:
Line 12, "ends" should read --end--.

COLUMN 41:
Line 38, "ends" should be --end--.

Signed and Sealed this

Third Day of February, 2009

JOHN DOLL
*Acting Director of the United States Patent and Trademark Office*